US008567639B2

(12) United States Patent
Kim

(10) Patent No.: US 8,567,639 B2
(45) Date of Patent: Oct. 29, 2013

(54) MEDICINE FEEDING APPARATUS

(75) Inventor: Jun-Ho Kim, Daegu (KR)

(73) Assignee: JVM Co., Ltd., Daegu (KR)

( * ) Notice: Subject to any disclaimer, the term of this patent is extended or adjusted under 35 U.S.C. 154(b) by 235 days.

(21) Appl. No.: 13/073,214

(22) Filed: Mar. 28, 2011

(65) Prior Publication Data

US 2012/0239186 A1 Sep. 20, 2012

(30) Foreign Application Priority Data

Mar. 15, 2011 (KR) ..... 10-2011-0022971
Mar. 15, 2011 (KR) ..... 10-2011-0022972
Mar. 15, 2011 (KR) ..... 10-2011-0022973
Mar. 15, 2011 (KR) ..... 10-2011-0022974
Mar. 15, 2011 (KR) ..... 10-2011-0022975

(51) Int. Cl.
*A47F 1/04* (2006.01)

(52) U.S. Cl.
USPC ..... 221/154; 700/242

(58) Field of Classification Search
USPC ..... 221/154
See application file for complete search history.

(56) References Cited

U.S. PATENT DOCUMENTS 5,190,185 A * 3/1993 Blechl ..... 221/154
5,628,551 A * 5/1997 Block ..... 312/235.7
6,056,150 A * 5/2000 Kasper ..... 221/154
6,098,837 A * 8/2000 Izawa et al. ..... 221/154
6,367,653 B1 * 4/2002 Ruskin et al. ..... 221/1
7,178,717 B1 * 2/2007 Lindell ..... 232/45
7,428,806 B2 * 9/2008 Kim ..... 53/154
7,562,791 B2 * 7/2009 Yuyama et al. ..... 221/265

* cited by examiner

*Primary Examiner* — Timothy Waggoner
(74) *Attorney, Agent, or Firm* — Novick, Kim & Lee, PLLC; Jae Youn Kim

(57) ABSTRACT

Disclosed is a medicine feeding apparatus. The medicine feeding apparatus includes a medicine cartridge, a cartridge mount, a medicine discharge mechanism, and a discharge drive mechanism. The medicine cartridge has an entrance opening formed in the top thereof, through which a medicine product is put into the medicine cartridge, and a discharge hole formed in a front position of the bottom thereof, through which the medicine product is discharged from the medicine cartridge by operation of the medicine discharge mechanism. The entrance opening is provided with a cover. The medicine cartridge is mounted on an upper surface of the cartridge mount, and the cartridge mount has an outer discharge hole communicating with the discharge hole to discharge the medicine product from the cartridge mount. The discharge drive mechanism is provided at the medicine cartridge and the cartridge mount and serves to drive the medicine discharge mechanism.

24 Claims, 27 Drawing Sheets

MEDICINE FEEDING APPARATUS

BACKGROUND OF THE INVENTION

1. Field of the Invention

The present invention relates to a medicine feeding apparatus, and more particularly, to a medicine feeding apparatus, which can prevent medicine from being damaged in the course of being dispensed in the case where medicine products are not equal in shape or are fragile.

2. Description of the Related Art

Generally, there are various kinds and shapes of medicine products.

Especially, ampoules or vials are not equal in shape and automated feeding thereof is difficult. These ampoules or vials tend to be easily damaged even by low shock because they are made of fragile glass and have a recessed portion between upper and lower ends thereof to allow a user to use medicine received in an ampoule by pressing the recessed portion.

There are also pouch type medicine products in which medicine is put into a paper or vinyl pouch having an open end and the open end of the pouch is sealed before the medicine product is dispensed to patients.

In the case of the pouch type medicine products, pouches become unequal in shape depending on medicine, such as tablets or medicinal powder, received in the pouches and thus, are likely to be damaged upon collision therebetween, which may cause invasion of foreign substances into the pouches or discharge of medicine from the pouches, resulting in damage to medicine.

In addition, Press Through Pack (PTP) type medicine products are prepared by putting medicine into a receptacle conforming to the shape of the medicine and attaching a cover to an opening of the receptacle by, e.g., lamination, to allow a user to tear off the cover and take the medicine.

The PTP type medicine products are generally made of a material to allow the user to easily tear off the cover and tend to be easily damaged even by low shock, thus requiring careful handling in storage or feeding of medicine.

There is a demand for an automated medicine feeding apparatus capable of automatically feeding all the above described medicine products without a risk of damage to medicine.

In addition, storage and feeding of medicine to be dispensed based on a prescription should be carefully handled, and in the case of special medicine, only an authorized user should be allowed to access the medicine.

SUMMARY OF THE INVENTION

Therefore, the present invention has been made in view of the above problems, and it is one object of the present invention to provide a medicine feeding apparatus in which medicine products accommodated in a medicine cartridge are automatically discharged when the medicine cartridge is mounted on a cartridge mount.

It is another object of the present invention to provide a medicine feeding apparatus in which medicine products accommodated in a medicine cartridge are discharged along an inclined bottom surface of the medicine cartridge without a separate member to push the medicine products within the medicine cartridge.

It is another object of the present invention to provide a medicine feeding apparatus in which if medicine products methodically accommodated in a medicine cartridge are not discharged even after a discharge hole of the medicine cartridge is opened, an opening degree of the discharge hole is increased to facilitate dispersion and discharge of the medicine products.

It is another object of the present invention to provide a medicine feeding apparatus in which a medicine cartridge is provided with a discharge member to control an opening degree of a discharge hole.

It is another object of the present invention to provide a medicine feeding apparatus in which medicine products accommodated in a medicine cartridge are kept in fixed positions without a risk of collision therebetween.

It is another object of the present invention to provide a medicine feeding apparatus in which a plurality of medicine products is respectively received in partitioned spaces so as not to come into contact with each other and be discharged one by one.

It is a further object of the present invention to provide a medicine feeding apparatus in which if a plurality of medicine cartridges is vertically arranged, medicine products accommodated in an uppermost one of the medicine cartridges are discharged first under guidance.

In accordance with one aspect of the present invention, the above and other objects can be accomplished by the provision of a medicine feeding apparatus including a medicine cartridge having an entrance opening formed in the top thereof, through which a medicine product is put into the medicine cartridge, the entrance opening being provided with a cover, and a discharge hole formed in a front position of the bottom thereof, through which the medicine product is discharged under operation of a medicine discharge mechanism provided at the medicine cartridge, a cartridge mount having an upper surface, on which the medicine cartridge is mounted, and an outer discharge hole communicating with the discharge hole to discharge the medicine product from the cartridge mount, and a discharge drive mechanism provided at the medicine cartridge and the cartridge mount to drive the medicine discharge mechanism.

The medicine cartridge may have an inclined inner bottom surface, the medicine discharge mechanism may include a discharge path spaced apart from the bottom surface and having an intermediate discharge hole located above the outer discharge hole of the cartridge mount, and a discharge member installed in the discharge path to open the discharge hole of the medicine cartridge to enable discharge of the medicine product through the discharge hole and close the discharge hole when the medicine product is discharged from the discharge path through the intermediate discharge hole and simultaneously, press the medicine product to discharge the medicine product to the outer discharge hole, and the discharge member may be driven by the discharge drive mechanism.

The discharge drive mechanism may include a rack member provided at a lower surface of the discharge member, a rotatable pinion member provided at the upper surface of the cartridge mount and engaged with the rack member, a discharge drive unit to drive the pinion member, and a discharge controller to control operation of the medicine discharge mechanism.

An elastic member may be installed in the discharge path and is connected to the discharge member so as to return the discharge member to an original position thereof after the discharge member is moved to open the discharge hole.

The medicine discharge mechanism may further include a discharge sensor to sense whether or not the medicine product is discharged through the discharge hole of the medicine cartridge and send the sensed signal to the discharge controller.

If the discharge sensor does not sense discharge of the medicine product, the discharge controller may send a drive signal to the discharge drive unit so as to further open the discharge hole via movement of the discharge member.

The medicine discharge mechanism may further include a discharge member position sensor to sense a position of the discharge member so as to control a movement interval of the discharge member by the discharge drive unit.

The medicine cartridge may be provided with a space modifier unit to adjust the size of an accommodation space to match to the size of the medicine product accommodated in the medicine cartridge.

The space modifier unit may include slot members respectively provided at opposite inner surfaces of the medicine cartridge and each having a plurality of slots, and an inner partition member, both ends of which are inserted into the slots of the slot members to divide the interior of the medicine cartridge.

A discharge locker may be provided at the medicine cartridge and the cartridge mount to lock operation of the discharge drive mechanism.

The discharge locker may include a stationary magnet accommodating recess indented in the upper surface of the cartridge mount to accommodate a stationary magnet therein, and a movable magnet accommodating recess indented in a lower surface of the medicine cartridge at a position corresponding to the stationary magnet accommodating recess to accommodate a movable magnet therein, and the movable magnet accommodating recess may be defined in the lower surface of the medicine cartridge and the discharge member such that an upper portion of the movable magnet is inserted into the discharge member and a lower portion of the movable magnet is inserted into the lower surface of the medicine cartridge.

An elastic member may be installed in a lower region of the movable magnet accommodating recess to push the upper portion of the movable magnet into the discharge member.

The medicine discharge mechanism may include rotating shafts rotatably installed in front and rear positions of the medicine cartridge, and a conveyor belt installed to connect the front and rear rotating shafts to each other and engaged with and rotated by the front and rear rotating shafts, and the rotating shafts may be driven by the discharge drive mechanism.

The conveyor belt may be a partitioned conveyor belt provided at an upper surface thereof with a plurality of partition members parallel to the rotating shafts to provide a plurality of divided spaces.

The conveyor belt may be a slit conveyor belt provided at an upper surface thereof with a plurality of slits such that one end of the medicine product is inserted into a corresponding one of the slits.

The partitioned conveyor belt may be divided into two conveyor belts in a direction perpendicular to the rotating shafts.

The partition members on the upper surface of one partitioned conveyor belt may be alternately arranged with the partition members on the upper surface of the other partitioned conveyor belt.

An intermediate partition member may be interposed between the two partitioned conveyor belts.

The intermediate partition member may be separably installed to come into contact with the front and rear surfaces of the medicine cartridge such that the partition members on the partitioned conveyor belt come into contact with opposite surfaces of the intermediate partition member.

The discharge drive mechanism may include a discharge drive unit installed in the cartridge mount, a discharge driving gear to be driven by the discharge drive unit, an upper portion of the discharge driving gear being exposed from the upper surface of the cartridge mount, a discharge driven gear provided at the bottom of the medicine cartridge and engaged with and rotated by the discharge driving gear, a rotation drive shaft member connected to the discharge driven gear so as to be rotated along with the discharge driven gear, and a rotation drive belt connecting the rotation drive shaft member and the rotating shaft to each other.

The rotation drive shaft member may be provided with a partition member position sensor to sense a position of the partition member on the partitioned conveyor belt so as to control operation of the discharge drive unit.

The medicine discharge mechanism may include screw members rotatably installed at opposite inner sides of the medicine cartridge and each having screw threads formed on an outer surface thereof, and rotating shaft members inserted respectively into the screw members to rotate the screw members, both ends of each rotating shaft member being connected to inner front and rear surfaces of the medicine cartridge, and the rotating shaft members may be driven by the discharge drive mechanism.

A distance between the screw members may match to a length of the medicine product.

A distance between the screw threads formed on the outer surface of the screw member may match to a thickness of the medicine product.

The discharge drive mechanism may include a discharge drive unit installed in the cartridge mount, a discharge driving gear installed on the cartridge mount and adapted to be rotated by the discharge drive unit, a discharge driven gear provided at the bottom of the medicine cartridge so as to be engaged with the discharge driving gear, the discharge driven gear being placed and rotated on a discharge shaft member parallel to the front surface of the medicine cartridge, a first helical gear placed on an end of the discharge shaft member, a second helical gear engaged at a right angle with the first helical gear to allow a rotation drive shaft member to be rotated in linkage with the first helical gear, a rotation driving gear placed on an end of the rotation drive shaft member at the rear surface of the medicine cartridge, and rotation driven gears engaged with the rotation driving gear and placed respectively on the rotating shaft members so as to rotate the rotating shaft members.

The medicine discharge mechanism may include a bottom member spaced apart from the bottom surface of the medicine cartridge and having a front opening corresponding to the discharge hole and a rear hole, a moving member having opposite lower ends seated on opposite sides of the bottom member and adapted to be moved forward or rearward of the bottom member, a support member provided at a front surface of the moving member so as to come into contact with the medicine product accommodated in the medicine cartridge to assist discharge of the medicine product through the discharge hole, a movable elastic member having a winding roll installed at the rear hole of the bottom member to come into contact with the bottom surface of the medicine cartridge and an elastic piece secured to the bottom member so as to be wound on or unwound from the winding roll and serving to move the moving member, and a discharge roller member provided at one side of the discharge hole, and the discharge roller member may be driven by the discharge drive mechanism.

The discharge drive mechanism may include a discharge drive unit installed in the cartridge mount, a discharge driving gear to be driven by the discharge drive unit, an upper portion of which is exposed from the upper surface of the cartridge mount, a discharge driven gear provided at the bottom of the medicine cartridge and engaged with and rotated by the discharge driving gear, a rotation drive shaft member rotatably connected to the discharge driven gear, a discharge roller member installed at one side of the discharge hole, and a discharge drive belt connecting the rotation drive shaft member and the discharge roller member to each other.

A discharge guide member may be installed to the inner front surface of the medicine cartridge and may be configured to cover the top of the discharge roller member so as to guide a contact position between the discharge roller member and the medicine product.

The medicine cartridge may be provided with a cover locker to lock the cover used to cover the entrance opening of the medicine cartridge.

The cover locker may include a protrusion protruding downward from an end of the cover to lock the cover simultaneously with that the cover covers the entrance opening, a retainer member provided at the rear surface of the medicine cartridge and having a recess corresponding to the protrusion of the cover such that the protrusion is inserted into or separated from the recess as the retainer member is moved in a given direction or an opposite direction, and an elastic member connected to the retainer member to allow the retainer member, which has been moved when the protrusion is inserted into the recess, to be returned to an original position thereof.

The cover locker may further include a locking member adapted to be moved by a key member and serving to move the retainer member in a given direction so as to separate the protrusion from the recess.

The cover locker may further include a locking guide member located at the outside of a path along which the protrusion is inserted into the recess so as to surround an outer surface of the protrusion, thereby serving to guide the protrusion to be caught by or released from the recess of the retainer member.

The cover locker may further include an anti-opening structure to prevent opening of the entrance opening of the medicine cartridge even if the key member is used in a state in which the entrance opening of the medicine cartridge faces downward.

The anti-opening structure may include a toothed portion provided at a lower surface of the retainer member, a stopper member having a toothed portion to be engaged with the toothed portion, a stopper positioning member configured to surround a lower surface of the stopper member and serving to position the stopper member such that the stopper member is movable by a predetermined distance so as to come into contact with the toothed portion of the retainer member or be spaced apart from the toothed portion, and a rear cover to cover the rear surface of the medicine cartridge to which the cover locker is installed.

A cartridge locker may be provided at the medicine cartridge and the cartridge mount to lock the medicine cartridge mounted on the cartridge mount.

The cartridge locker may include a coupling protrusion protruding from the rear surface of the medicine cartridge, and a coupling recess indented in the cartridge mount at a position corresponding to the coupling protrusion for insertion of the coupling protrusion.

The cartridge locker may further include a rotatable pressure member installed at one side of the coupling recess, the rotatable pressure member being rotated to press the coupling protrusion inserted in the coupling recess so as to separate the coupling protrusion from the coupling recess, and a drive unit to drive the rotatable pressure member.

An elastic member may be provided at one side of the rotatable pressure member to return the rotatable pressure member to an original position thereof.

The cartridge locker may further include at least one damping boss protruding from the rear surface of the medicine cartridge to alleviate shock generated when the medicine cartridge is mounted on the cartridge mount, and an elastic damping member provided at the cartridge mount to come into contact with the damping boss when the medicine cartridge is mounted on the cartridge mount.

The cartridge locker may further include a memory chip attached to the rear surface of the medicine cartridge, the memory chip storing information on the medicine produce accommodated in the medicine cartridge, and a memory reader attached to the cartridge mount to read the information stored in the memory chip.

In accordance with another aspect of the present invention, there is provided a medicine feeding apparatus including a main body, a plurality of cartridge mounts installed in the main body to support medicine cartridges in which a medicine product is accommodated, and a transfer device on which the medicine product discharged from an outer discharge hole perforated in the bottom of each cartridge mount is seated.

The medicine cartridge may include a downwardly inclined seating guide member extending from the upper surface thereof to guide the medicine product discharged from the outer discharge hole located thereabove to the transfer device.

A plurality of discharge grooves may be formed in an upper surface of the seating guide member to minimize a contact area between the medicine product and the seating guide member.

A raised grip portion may be formed at a lower surface of the seating guide member.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, preferred embodiments of the present invention will be described in detail with reference to the accompanying drawings.

Figure 1:
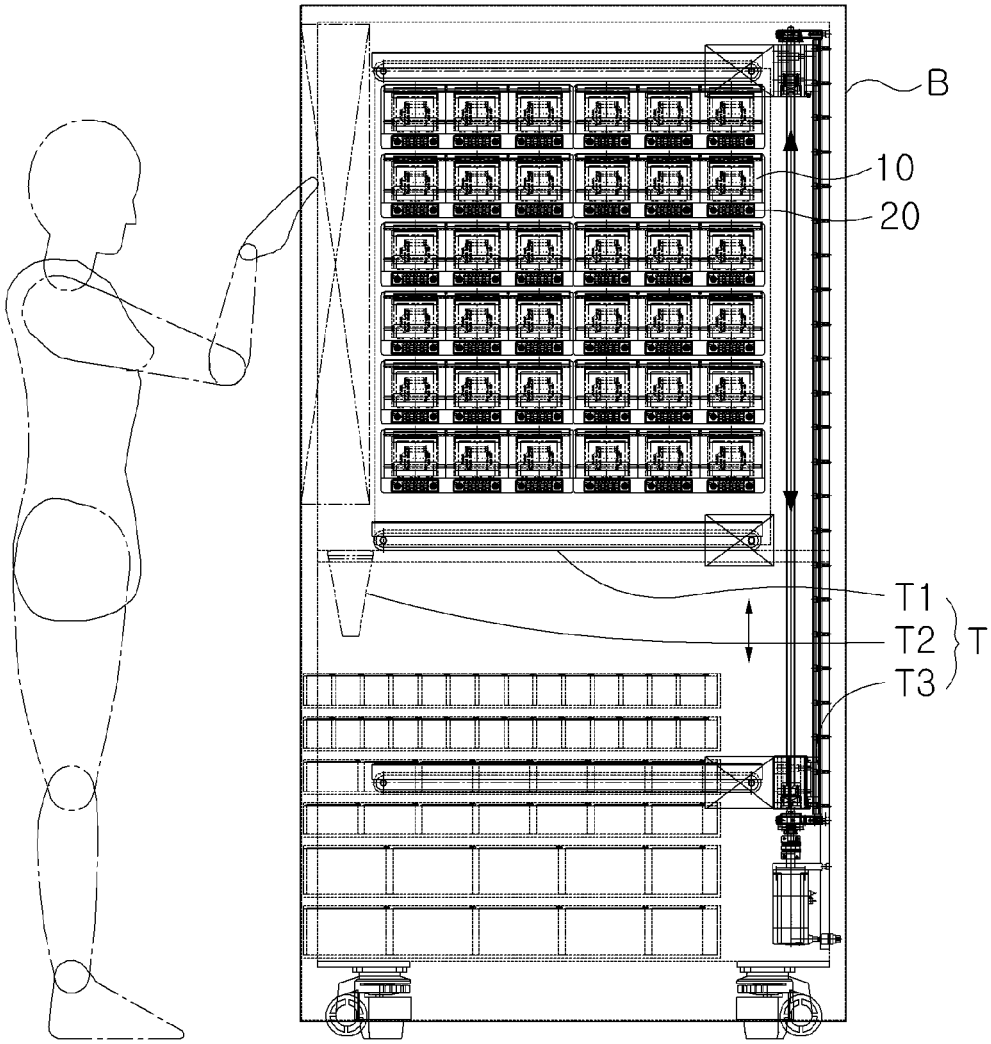
FIG. 1 is a view illustrating a medicine feeding apparatus according to the present invention.
Figure 2:
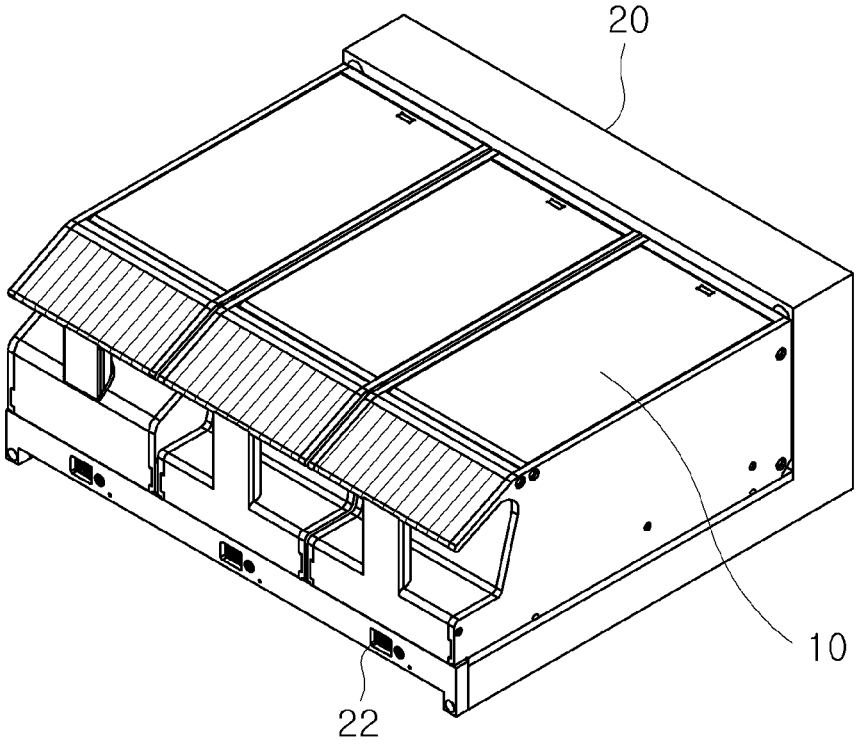
FIG. 2 is a view illustrating a medicine cartridge mounted on a cartridge mount of the medicine feeding apparatus according to the present invention.

FIG. 1 is a view illustrating a medicine feeding apparatus according to the present invention, and FIG. 2 is a view illustrating a medicine cartridge mounted on a cartridge mount of the medicine feeding apparatus according to the present invention.

As illustrated, the medicine feeding apparatus of the present invention includes a main body B, a plurality of cartridge mounts 20 installed in the main body B to support medicine cartridges 10 in which medicine products M are accommodated, and a transfer device T on which the medicine products M discharged from an outer discharge hole perforated in the bottom of each cartridge mount 20 are seated prior to being discharged from the main body B and dispensed to patients.

The transfer device T includes a conveyor belt T1 which has a sufficient length to connect one side and the other side of the transfer device T to each other, a collector T2 which is located close to one side of the conveyor belt T1 and serves to collect the medicine products M seated on the conveyor belt T1 so as to discharge the medicine products M to the outside of the main body B, and an elevator T3 which serves to raise or lower the conveyor belt T1.

In the medicine feeding apparatus having the above described configuration, the medicine products M discharged from the medicine cartridges 10 are delivered to a user via the transfer device T.

As illustrated in FIG. 2, the medicine cartridge 10, in which the medicine products M are accommodated, is mounted on the cartridge mount 20 such that the medicine products M can be discharged to the outside through the cartridge mount 20.

In the present invention, the medicine cartridge 10 and the cartridge mount 20 are provided with a medicine discharge mechanism to discharge the medicine products M accommodated in the medicine cartridge 10, a discharge drive mechanism to drive the medicine discharge mechanism, and a locking mechanism to lock the medicine cartridge 10 to prevent unwanted opening thereof and to prevent an unauthorized user from arbitrarily discharging the medicine products M in a state in which the medicine cartridge 10 is mounted on the cartridge mount 20.

In an embodiment, the medicine cartridge 10 may accommodate fragile medicine products, such as ampoules or vials, or medicine products using packing materials that are easily damaged, such as pouch type medicine products or Press Through Pack (PTP) type medicine products. The medicine cartridge 10 is configured to discharge the medicine products one by one.

Hereinafter, several embodiments of the medicine cartridge based on characteristics of different medicine products will be described in detail.

Figure 3:
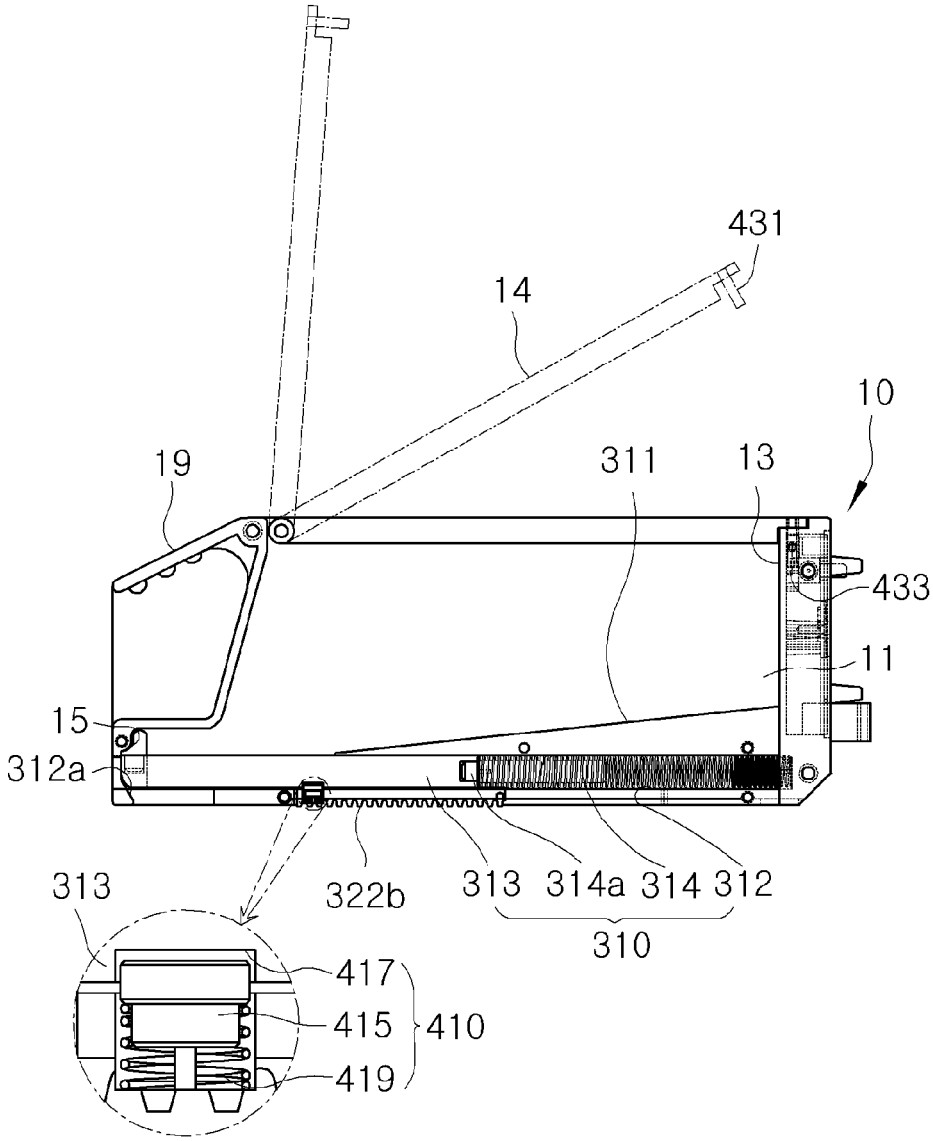
FIG. 3 is a view illustrating the medicine cartridge of the medicine feeding apparatus according to a first embodiment of the present invention.
Figure 4:
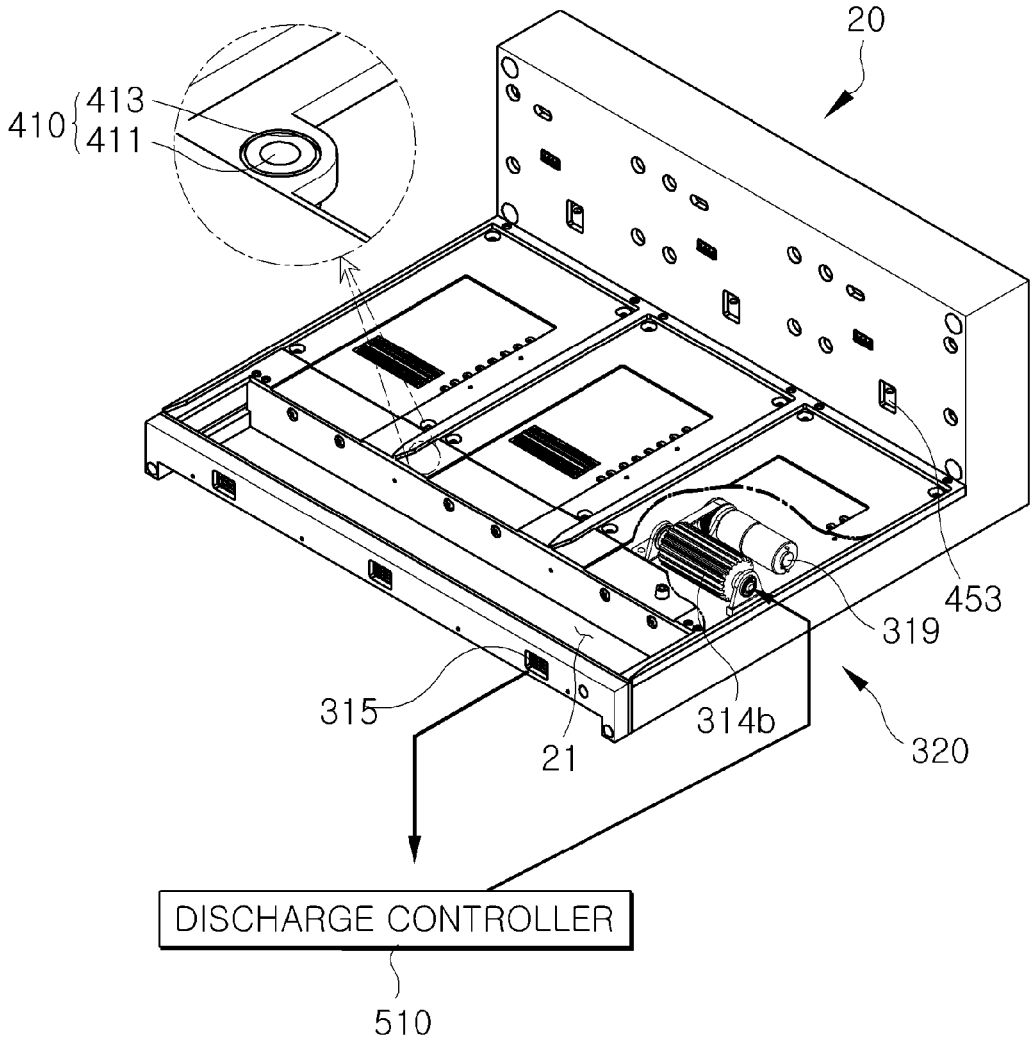
FIG. 4 is a view illustrating the cartridge mount of the medicine feeding apparatus according to the first embodiment of the present invention.

FIG. 3 is a view illustrating the medicine cartridge of the medicine feeding apparatus according to a first embodiment of the present invention, and FIG. 4 is a view illustrating the cartridge mount of the medicine feeding apparatus according to the first embodiment of the present invention.

Figure 5:
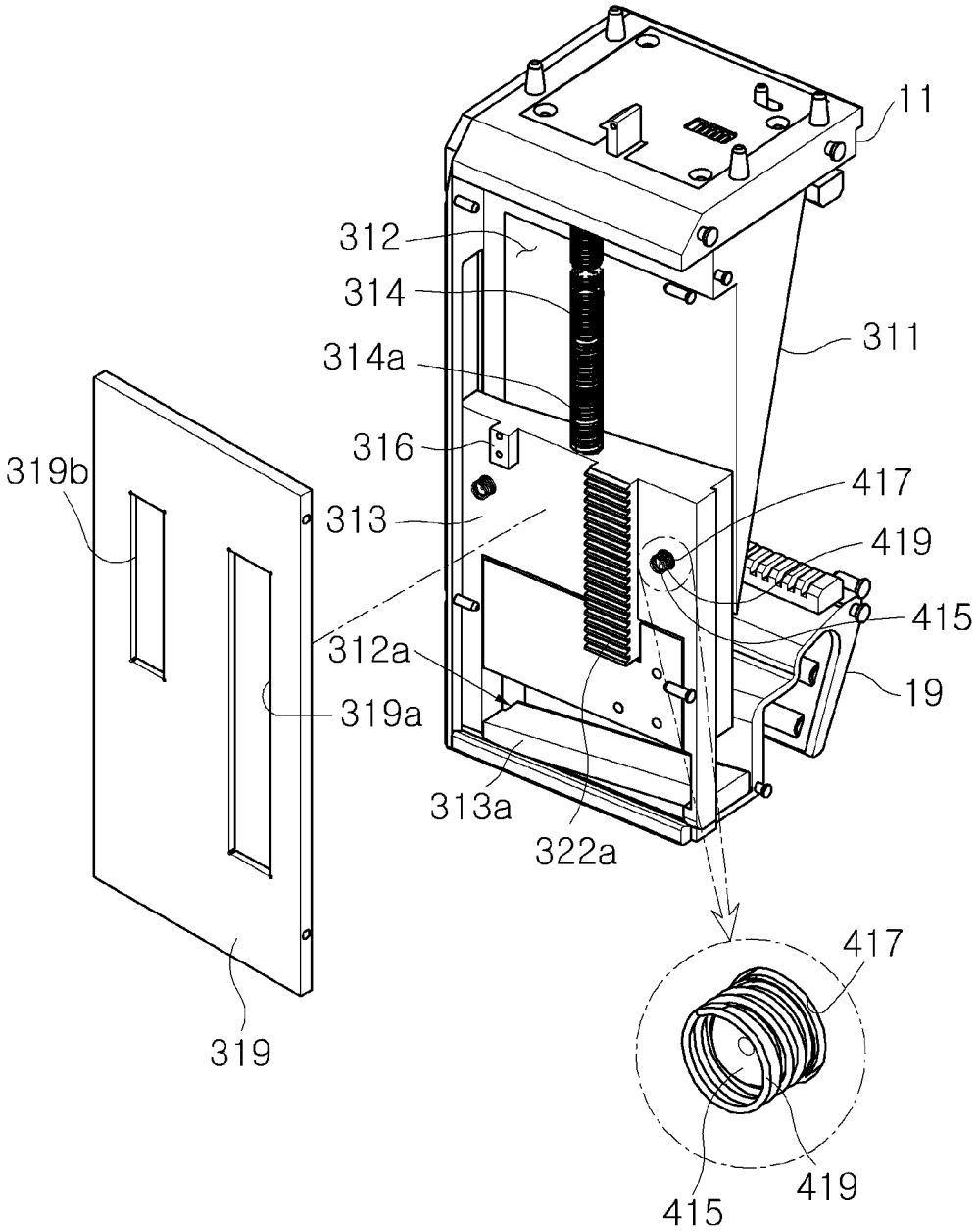
FIG. 5 is a view illustrating the medicine cartridge, from which a lower cover is separated, according to the first embodiment of the present invention.
Figure 6:
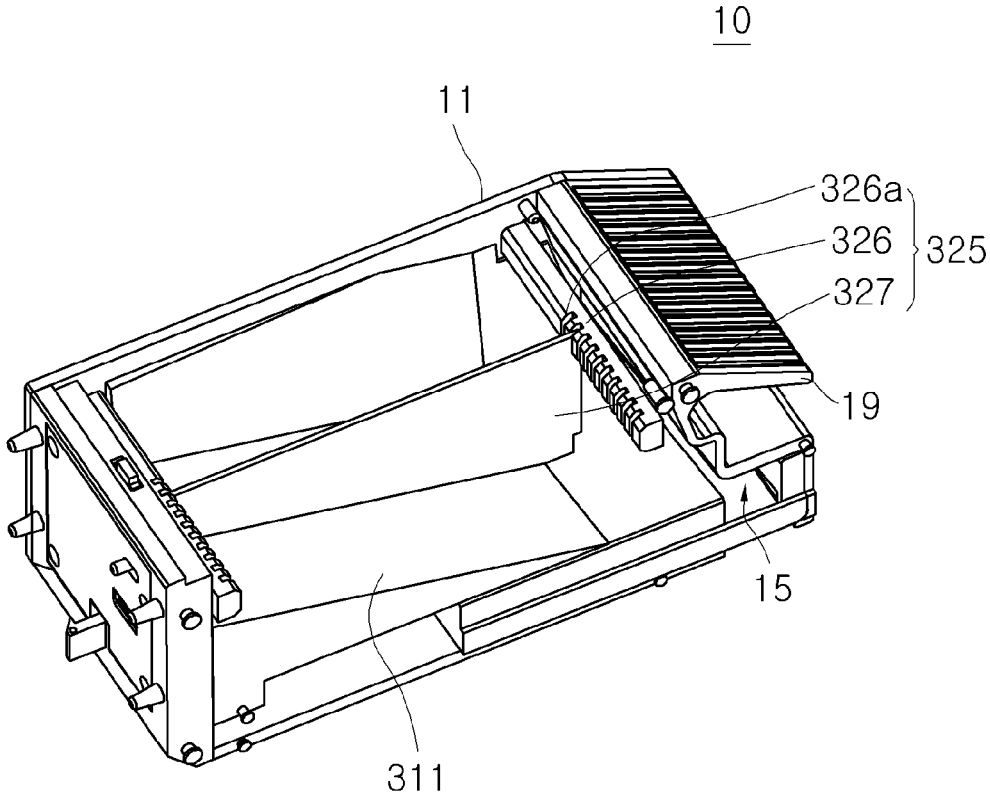
FIG. 6 is a view illustrating the interior of the medicine cartridge according to the first embodiment of the present invention.

FIG. 5 is a view illustrating the medicine cartridge, from which a lower cover is separated, according to the first embodiment of the present invention, and FIG. 6 is a view illustrating the interior of the medicine cartridge according to the first embodiment of the present invention.

The medicine cartridge 10, as illustrated, includes a cartridge body 11 internally defining a space in which the medicine products M are accommodated. The cartridge body 11 is provided at the top thereof with an entrance opening 13, through which the medicine products M are put into the cartridge body 11, and at the bottom thereof with a discharge hole 15, through which the medicine products M are discharged from the cartridge body 11.

More specifically, the entrance opening 13 is covered with a cover 14 as the cover 14 is rotated upward when the cartridge body 11 is filled with the medicine products M, and the discharge hole 15 is opened or closed by the medicine discharge mechanism 310 which will be described hereinafter.

Here, the cartridge body 11 takes the form of a box, the top of which is wholly open and the bottom of which is partially open at one side. Preferably, the cartridge body 11 has an inclined inner bottom surface 311 such that the medicine products M are moved to the discharge hole 15 along the inclined surface 311 when the discharge hole 15 is opened.

The medicine discharge mechanism 310 is provided at the bottom of the medicine cartridge 10 and the top of the cartridge mount 20 and serves to discharge fragile cylindrical medicine products M, such as ampoules. The medicine discharge mechanism 310 includes a discharge path 312 provided at the bottom of the medicine cartridge 10, the discharge path 312 having an intermediate discharge hole 312*a* above the outer discharge hole 21 of the cartridge mount 20, and a discharge member 313 installed in the discharge path 312, the discharge member 313 serving not only to open or close the discharge hole 15, but also to push the medicine products M discharged from the medicine cartridge 10. The discharge hole 15 is opened or closed as the discharge member 313 is moved to one side or the other side of the discharge path 312.

The discharge drive mechanism 320 serves to move the discharge member 313 of the medicine discharge mechanism 310 so as to open or close the discharge hole 15. Referring to FIG. 4, the discharge drive mechanism 320 includes a rack member 322*a* provided at a lower surface of the discharge member 313, a rotatable pinion member 322*b* provided at an upper surface of the cartridge mount 20 and engaged with the rack member 322*a*, a discharge drive unit 321 to rotate the pinion member 322*b*, and a discharge controller 510 to control operation of the medicine discharge mechanism 310.

More specifically, as illustrated in FIG. 5, the discharge path 312 is integrally formed with the cartridge body 11 and provides a predetermined space in which the discharge member 313 is installed below the discharge hole 15 of the cartridge body 11 and is moved to open or close the discharge hole 15.

The intermediate discharge hole 312*a* of the discharge path 312 is located toward an inner front surface of the cartridge body 11 to communicate the discharge hole 15 of the medicine cartridge 10 and the outer discharge hole 21 of the cartridge mount 20 with each other.

A discharge guide member 313*a* is installed in the discharge path 312 and serves to guide an ampoule, upper and lower ends of which have different sizes. Specifically, the discharge guide member 313*a* is attached to the inner front surface of the cartridge body 11 where the discharge hole 15 and the intermediate discharge hole 312*a* are connected to each other. The discharge guide member 313*a* is configured to reduce a width of one side of the discharge hole 15 to match to the shape of the ampoule, upper and lower ends of which have different sizes. Preferably, the discharge guide member 313*a* is obliquely installed to reduce a width of a partial region of the discharge hole 15 through which the upper end of the ampoule is discharged.

In addition, an elastic member 314 is located in a rear region of the discharge path 312 and is connected to a rear surface of the discharge member 313. The elastic member 314 is pressed when the discharge member 313 is moved rearward in the discharge path 312 to open the discharge hole 15 and the intermediate discharge hole 312*a* and allows the discharge member 313 to be easily returned to an original position thereof. The elastic member 314 is wound on an elastic member support 314*a* installed to the rear surface of the discharge member 313, the elastic member support 314*a* having a length less than a movement distance of the discharge member 313.

The lower surface of the discharge member 313, on which the rack member 322*a* of the discharge drive mechanism 320 is provided, is covered with a lower cover 319. In this case, the rack member 322*a* may be integrally formed with the lower surface of the discharge member 313, and the lower cover 319 is preferably provided with a hole 319*a* through which the rack member 322*a* is exposed to the outside.

The pinion member 322*b* takes the form of a roller, an outer surface of which can be engaged with the rack member 322*a*. The pinion member 322*b* is provided at the upper surface of the cartridge mount 20 and is engaged with the rack member 322*a* so as to be rotated by the discharge drive unit 321.

The discharge drive unit 321 is driven to rotate the pinion member 322*b* upon receiving a drive signal from the discharge controller 510 when a user inputs a medicine feeding signal to the discharge controller 510. Thus, as the rack member 322*a* engaged with the pinion member 322*b*, i.e. the discharge member 313 is moved to one side or the other side of the discharge path 312 according to a rotating direction of the pinion member 322*b*, the discharge hole 15 is opened or closed by the discharge member 313.

The medicine discharge mechanism 310 further includes a discharge sensor 315 to sense whether or not the medicine product M is discharged through the discharge hole 15 of the medicine cartridge 10.

The discharge sensor 315 is located at the outer discharge hole 21 of the cartridge mount 20, and serves to sense whether or not the medicine product M discharged from the discharge hole 15 of the medicine cartridge 10 is discharged to the outside through the intermediate discharge hole 312*a* of the discharge path 312 and the outer discharge hole 21 of the cartridge mount 20 and send the sensed result to the discharge controller 510.

In this case, it will be appreciated that the discharge controller 510 functions to count the number of medicine products sensed by the discharge sensor 315, i.e. the number of discharged medicine products. Specifically, the discharge controller 510 functions to count the number of medicine products M discharged after the medicine cartridge 10 is initially mounted on the cartridge mount 20. As such, the number of medicine products M remaining in the medicine cartridge 10 can be calculated and thus, an accurate time when medicine products need to be added can be calculated.

If the discharge sensor 315 does not sense discharge of the medicine products M, the discharge controller 510 sends a drive signal to the discharge drive unit 321 so as to further move the discharge member 313, thereby allowing the discharge hole 15 to be further opened.

The medicine discharge mechanism 310 further includes a discharge member position sensor 316. The discharge member position sensor 316 serves to sense a position of the discharge member 313 and send the sensed result to the discharge controller 510. If the above described discharge sensor 315 does not sense discharge of the medicine products M and thus, the discharge controller 510 needs to further move the discharge member 313, the discharge controller 510 calculates a target position to which the discharge member 313 is moved upon receiving the sensed result from the discharge member position sensor 316, and drives the discharge drive unit 321 based on the calculated position.

Here, the discharge member position sensor 316 is attached to the lower surface of the discharge member 313 and thus, the lower cover 319 is further provided with a sensor hole 319*b* through which the discharge member position sensor 316 is exposed to the outside.

The cartridge body 11 of the prevent invention is provided with a space modifier unit 325. The space modifier unit 325 adjusts the interior space of the cartridge body 11 to match to the size of the medicine product M, e.g., the size of an ampoule accommodated in the cartridge body 11.

More specifically, as illustrated in FIG. 6, the space modifier unit 325 includes a pair of slot members 326 having a plurality of slots 326*a*, which are respectively provided at opposite inner surfaces, i.e. front and rear surfaces, of the cartridge body 11, and a space modifying member 327, both ends of which are inserted into the slots 326*a* of the slot members 326. In this case, a lower end of the space modifying member 327 comes into contact with the inclined bottom surface 311 of the cartridge body 11 and thus, is preferably inclined to match to the inclined bottom surface 311.

That is, when the space modifying member 327 is inserted into the slots 326*a* of the slot members 326 to define a medicine accommodation space, the slots 326*a* into which the space modifying member 327 is inserted are selected based on the length of the medicine products to be accommodated in the medicine accommodation space, which allows the size of the medicine accommodation space to be increased or decreased in proportion to the length of the medicine products.

As such, adjusting the size of the medicine accommodation space to match the length of the medicine products can prevent damage to the medicine products due to movement and collision between the medicine products within the cartridge body 11.

Figure 7A:
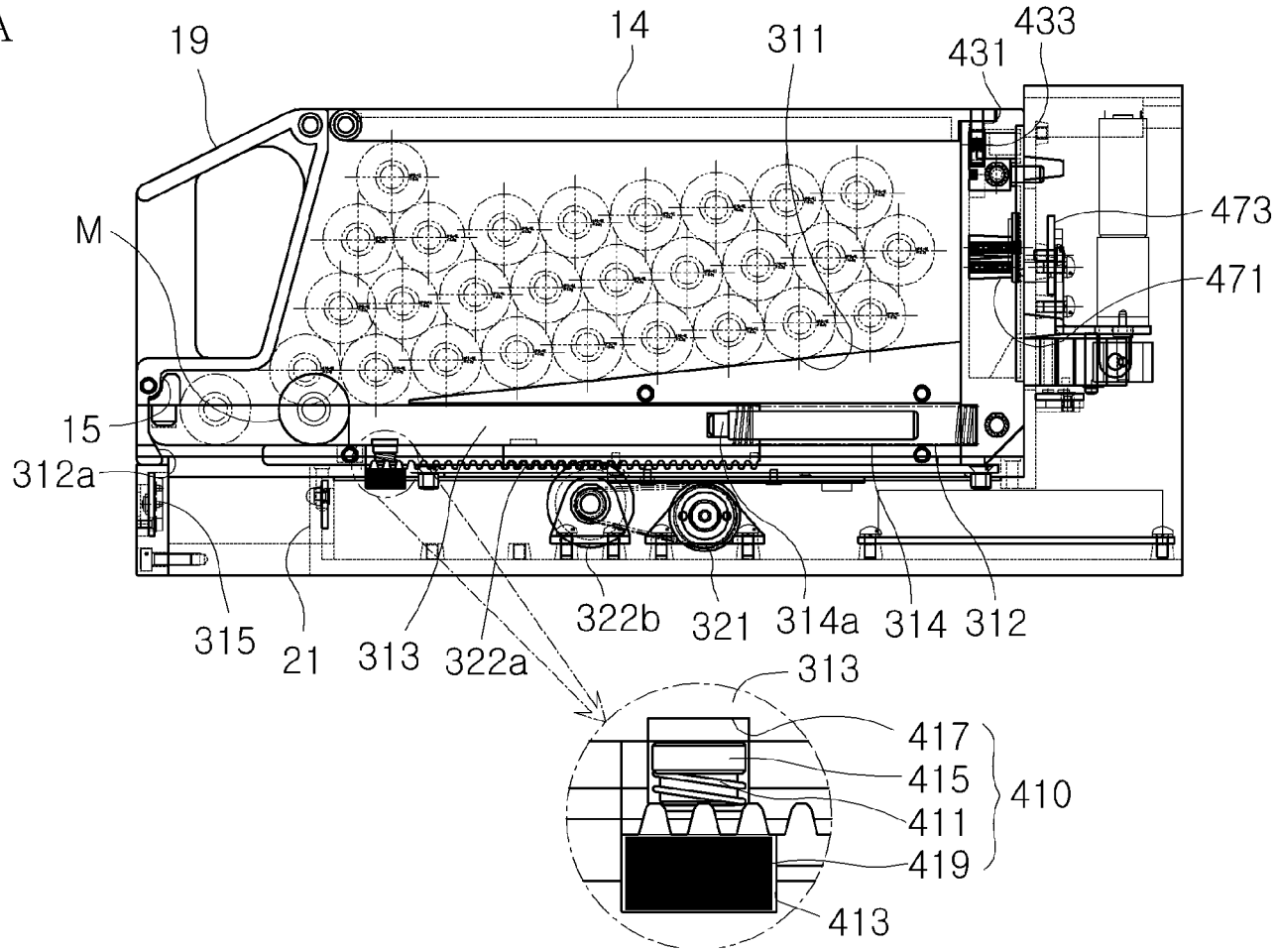
FIGS. 7A, 7B and 7C are views illustrating operation of a medicine discharge mechanism of the medicine feeding apparatus according to the first embodiment of the present invention.
Figure 7B:
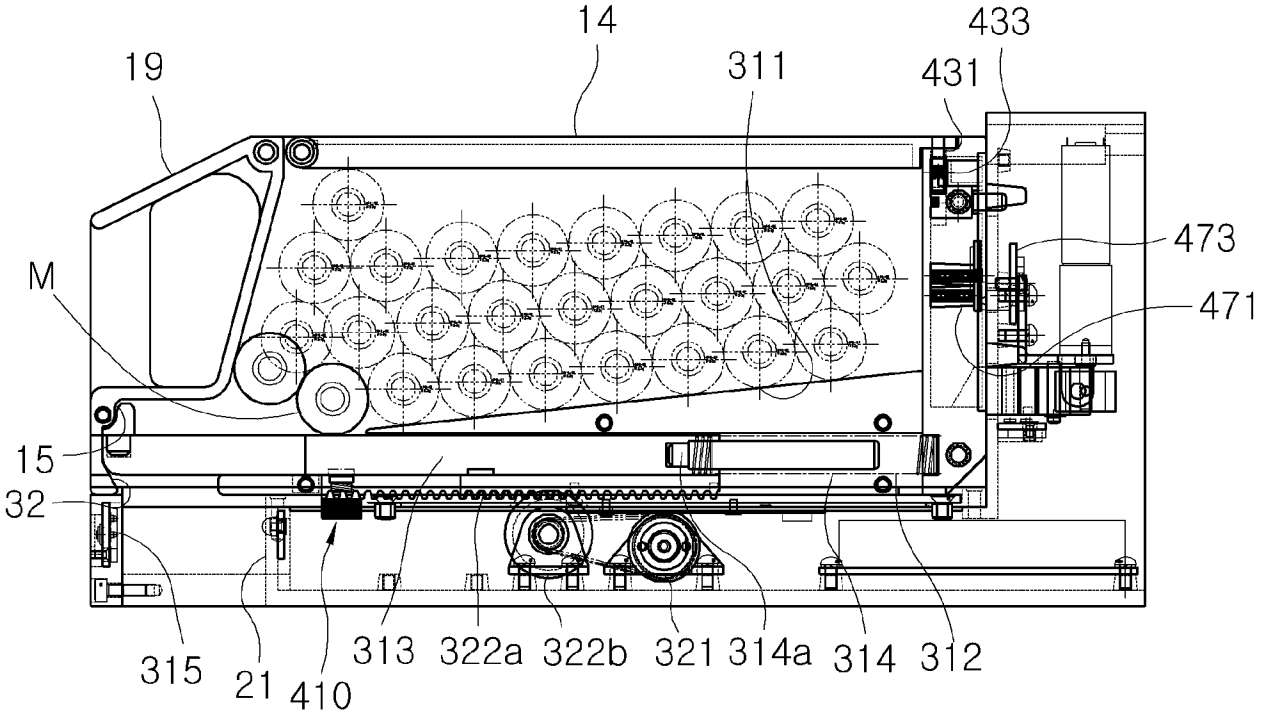
Figure 7C:
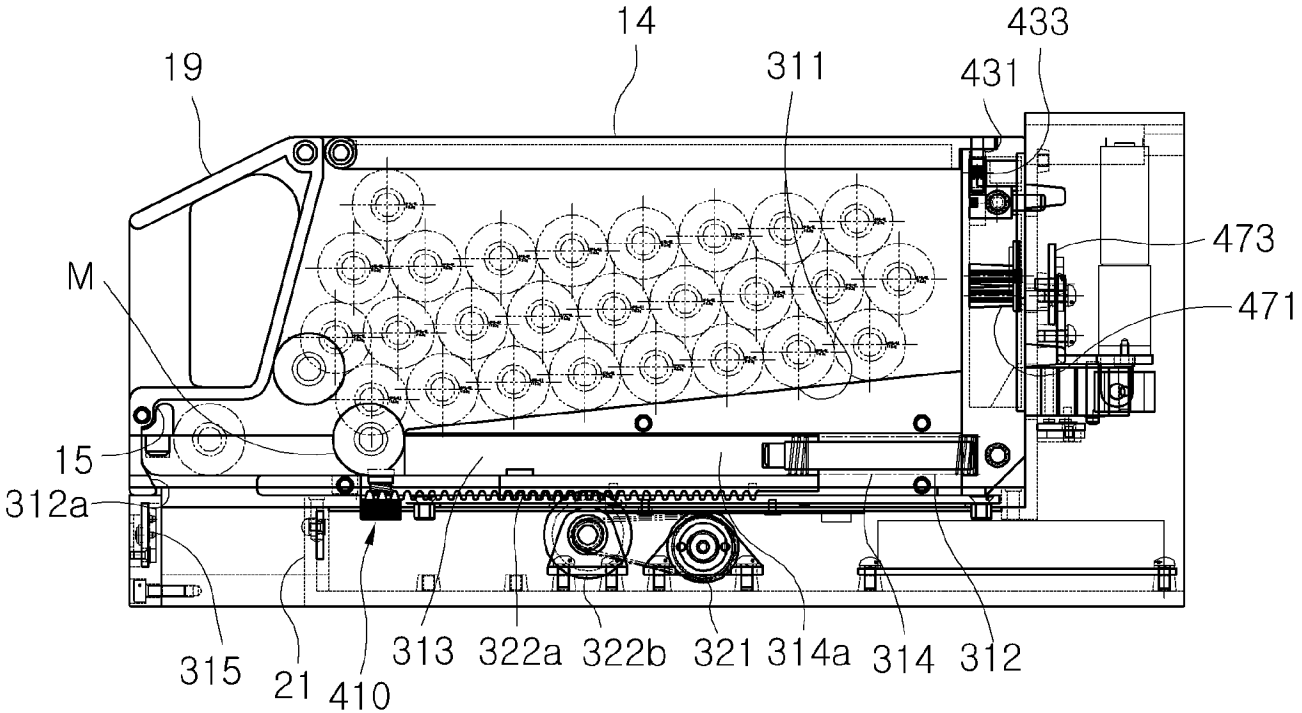

FIGS. 7A, 7B and 7C are views illustrating operation of the medicine discharge mechanism of the medicine feeding apparatus according to the first embodiment of the present invention.

The above described discharge hole 15, as illustrated in FIG. 7A, has a size greater than the size of the medicine products M accommodated in the medicine cartridge 10, and the discharge member 313 is initially positioned to open the discharge hole 15 by a minimum degree required to discharge the medicine product M.

More specifically, if the discharge drive unit 321 mounted to the cartridge mount 20 is driven to rotate the pinion member 322*b*, the discharge member 313 having the rack member 322*a* engaged with the pinion member 322*b* is moved, thereby opening the discharge hole 15.

If the medicine product M is discharged through the open discharge hole 15, the discharge sensor 315 senses the discharged medicine product M and sends the sensed result to the discharge controller 510. The discharge controller 510 counts the number of the medicine products M discharged from the medicine cartridge 10.

The discharge sensor 315 may do not sense discharge of the medicine products M for several reasons. Therefore, even if the medicine products M are not discharged from the discharge hole 15, the discharge sensor 315 sends the sensed result to the discharge controller 510, allowing the discharge controller 510 to give the user warning of no discharge of the medicine products M using a known means, such as an alarm, although not illustrated.

If the medicine products M accommodated in the cartridge body 11 have a cylindrical shape, for example, if the medicine products M are fragile glass ampoules or vials, as illustrated in FIG. 7B, the cylindrical medicine products M piled one above another within the cartridge body 11 are jammed and thus, cannot pass through the discharge hole 15 even if the discharge hole 15 is open.

If the medicine products M are not discharged for the above described reason and the discharge sensor 315 does not sense discharge of the medicine products M, the discharge sensor 315 sends the sensed result to the discharge controller 510. Thus, although the discharge member 313 has already been moved to open the discharge hole 15, the discharge controller 510 sends a drive signal to the discharge drive unit 321 such that the discharge drive unit 321 moves the discharge member 313 so as to further open the discharge hole 15.

In this case, the discharge member position sensor 316 senses the position of the discharge member 313 and sends the sensed result to the discharge controller 510. The discharge controller 510 sends a drive signal to the discharge drive unit 321 such that the discharge drive unit 321 moves the discharge member 313 to a target position.

Thereby, as illustrated in FIG. 7C, as the discharge hole 15 is opened by an opening degree greater than the size of the medicine product M, even the jammed medicine products M can be introduced into the discharge path 31 through the discharge hole 15. Then, as the discharge member 313 is returned to close the discharge hole 15, the discharge member 313 can act to push the medicine products M to the intermediate discharge hole 312*a*.

As the medicine products M are pushed to the intermediate discharge hole 312*a* by the discharge member 313, the medicine products M having passed through the intermediate discharge hole 312*a* are discharged to the outside through the outer discharge hole 21 oriented perpendicular to the intermediate discharge hole 312*a*. The discharge sensor 315 senses the discharged medicine products M and sends the sensed result to the discharge controller 510, allowing the discharge controller 510 to count the number of the discharged medicine products M.

The locking mechanism serves to prevent an unauthorized user from taking out the medicine products M. The locking mechanism includes a discharge locker 410 to lock operation of the medicine discharge mechanism 310 that opens or closes the discharge hole 15 of the medicine cartridge 10, a cover locker 430 to lock the cover 14 that covers the entrance opening 13 of the medicine cartridge 10, and a cartridge locker 450 to lock the medicine cartridge 10 once the medicine cartridge 10 is mounted on the cartridge mount 20.

Referring again to FIGS. 3 to 7A, the discharge locker 410 serves to prevent the discharge hole 15 from being arbitrarily opened during transfer of the medicine cartridge 10 prior to being mounted on the cartridge mount 20. The discharge locker 410 includes a stationary magnet accommodating recess 413 indented in the upper surface of the cartridge mount 20 such that a stationary magnet 411 is installed in the stationary magnet accommodating recess 413, and a movable magnet accommodating recess 417 formed in the lower surface of the medicine cartridge 10 at a position corresponding to the stationary magnet accommodating recess 413 such that a movable magnet 415 is installed in the movable magnet accommodating recess 417.

Here, the movable magnet accommodating recess 417 is configured to allow the movable magnet 415 to be inserted into the lower cover 319 of the medicine cartridge 10 and a lower surface of the discharge member 313 covering the discharge hole 15.

An elastic member 419 is installed beneath the movable magnet 415 to position the movable magnet 415 at the lower surface of the discharge member 313.

Specifically, the movable magnet 415 is raised by the elastic member 419 such that an upper end thereof is introduced into the lower surface of the discharge member 313 and a lower end thereof is located at the lower cover 319.

In this case, the stationary magnet 411 and the movable magnet 415 are oppositely charged magnets, such that attractive force is generated therebetween.

The upper end of the movable magnet 415 is located in the lower surface of the discharge member 313 before the medicine cartridge 10 is mounted on the cartridge mount 20 and thus, movement of the discharge member 313 is restricted by the movable magnet 415. This prevents the medicine products M from being discharged through the discharge hole 15.

Then, once the medicine cartridge 10 is mounted on the cartridge mount 20, the movable magnet 415 is introduced into the stationary magnet accommodating recess 413 located at a position corresponding to the movable magnet 415.

More specifically, the movable magnet 415 and the stationary magnet 411 of opposite magnetic polarities are likely to be adhered to each other by attractive force therebetween.

Thus, when the stationary magnet 411 and the movable magnet 415 are arranged to face each other as the medicine cartridge 10 is mounted on the cartridge mount 20, the movable magnet 415 escapes from the lower surface of the discharge member 313 and is lowered while pressing the elastic member 419 installed below the movable magnet 415, thereby being located close to the stationary magnet 411.

Thereby, as the movable magnet 415, which serves as a stopper inserted in the lower surface of the discharge member 313, is separated from the discharge member 313, the discharge member 313 can be moved by the discharge drive unit 321, thereby opening the discharge hole 15.

Hereinafter, operation of the medicine feeding apparatus having the above described configuration will be described in detail.

First, the medicine products M are put into the medicine cartridge 10 through the entrance opening 13 perforated in the top of the medicine cartridge 10.

Next, the medicine cartridge 10, in which the medicine products M are accommodated, is mounted on the cartridge mount 20. Simultaneously with that the medicine cartridge 10 is mounted on the cartridge mount 20, the discharge locker 410 unlocks the medicine discharge mechanism 310.

More specifically, once the medicine cartridge 10 is mounted on the cartridge mount 20, the movable magnet 415, which is installed at the bottom of the medicine cartridge 10 such that the upper end thereof is inserted into the discharge member 313, is moved downward from the movable magnet accommodating recess 417 while pressing the elastic member 419 by attractive force with the stationary magnet 415 installed in the upper surface of the cartridge mount 20, thereby being separated from the discharge member 313.

In this way, as the discharge locker 410 unlocks the medicine discharge mechanism 310, the discharge member 313 can be moved to open the discharge hole 15.

That is, the discharge locker 410 of the medicine cartridge 10 unlocks the medicine discharge mechanism 310 at the same time that a desired medicine cartridge 10 is mounted on the cartridge mount 20, enabling operation of the medicine discharge mechanism 310.

Next, the user inputs a medicine discharge signal to the corresponding medicine cartridge 10 to discharge the medicine products M.

In this case, the discharge controller 510 needs to count the number of the medicine products M accommodated in the medicine cartridge 10.

More specifically, if the discharge sensor 315 sends a signal informing of discharge of the medicine product M to the discharge controller 510 whenever the medicine product M is discharged, the discharge controller 510 can calculate the number of the medicine products M remaining in the medicine cartridge 10 by subtracting the number of the discharged medicine products M from the initial number of the medicine products M accommodated in the medicine cartridge 10.

If the calculated value indicates that the medicine cartridge 10 does not contain a sufficient number of the medicine products M to satisfy a discharge request, additional medicine products M are supplied into the medicine cartridge 10 via the above described process.

If a sufficient number of the medicine products M are accommodated in the medicine cartridge 10, the discharge controller 510 sends a drive signal to the discharge drive unit 321.

As the discharge drive unit 321 mounted to the cartridge mount 20 is operated to rotate the pinion member 322*b*, the rack member 322*a* engaged with the pinion member 322*b* is moved via rotation of the pinion member 322*b*.

Thereby, the discharge member 313 having the rack member 322*a* is moved in a given direction to open the discharge hole 15 of the medicine cartridge 10 while pressing the discharge member 313.

Once the discharge hole 15 is opened, the medicine product M accommodated in the cartridge body 11 is moved along the inclined bottom surface 311 of the cartridge body 11 and is introduced into the discharge path 312. The medicine product M introduced into the discharge path 312 is moved to the intermediate discharge hole 312*a* by the discharge member 313 as the discharge member 313 is returned to an original position thereof to close the discharge hole 15.

The medicine product M moved to the intermediate discharge hole 312*a* is discharged to the outside of the cartridge mount 20 through the outer discharge hole 21 of the cartridge mount 20.

In this case, the discharge sensor 315 mounted to the cartridge mount 20 sends a signal, which informs whether or not the medicine product M is discharged through the outer discharge hole 21, to the discharge controller 510.

If the discharge sensor 315 does not sense that the medicine product M is not discharged although the discharge member 313 is moved, the discharge controller 510 sends a drive signal to the discharge device unit 321 so as to further open the discharge hole 15 having a greater size than the size of the medicine product M.

More specifically, referring again to FIG. 7C, if the medicine product M is not discharged when the discharge hole 15 is initially opened, i.e. if the medicine products M in the form of cylindrical ampoules or vials are jammed and cannot be discharged through the discharge hole 15, it is necessary to sufficiently open the discharge hole 15 to disperse the jammed medicine products and allow the medicine products to be discharged through the discharge hole 15.

Then, the medicine products M are discharged to the outer discharge hole 21 through the above described process.

Figure 8:
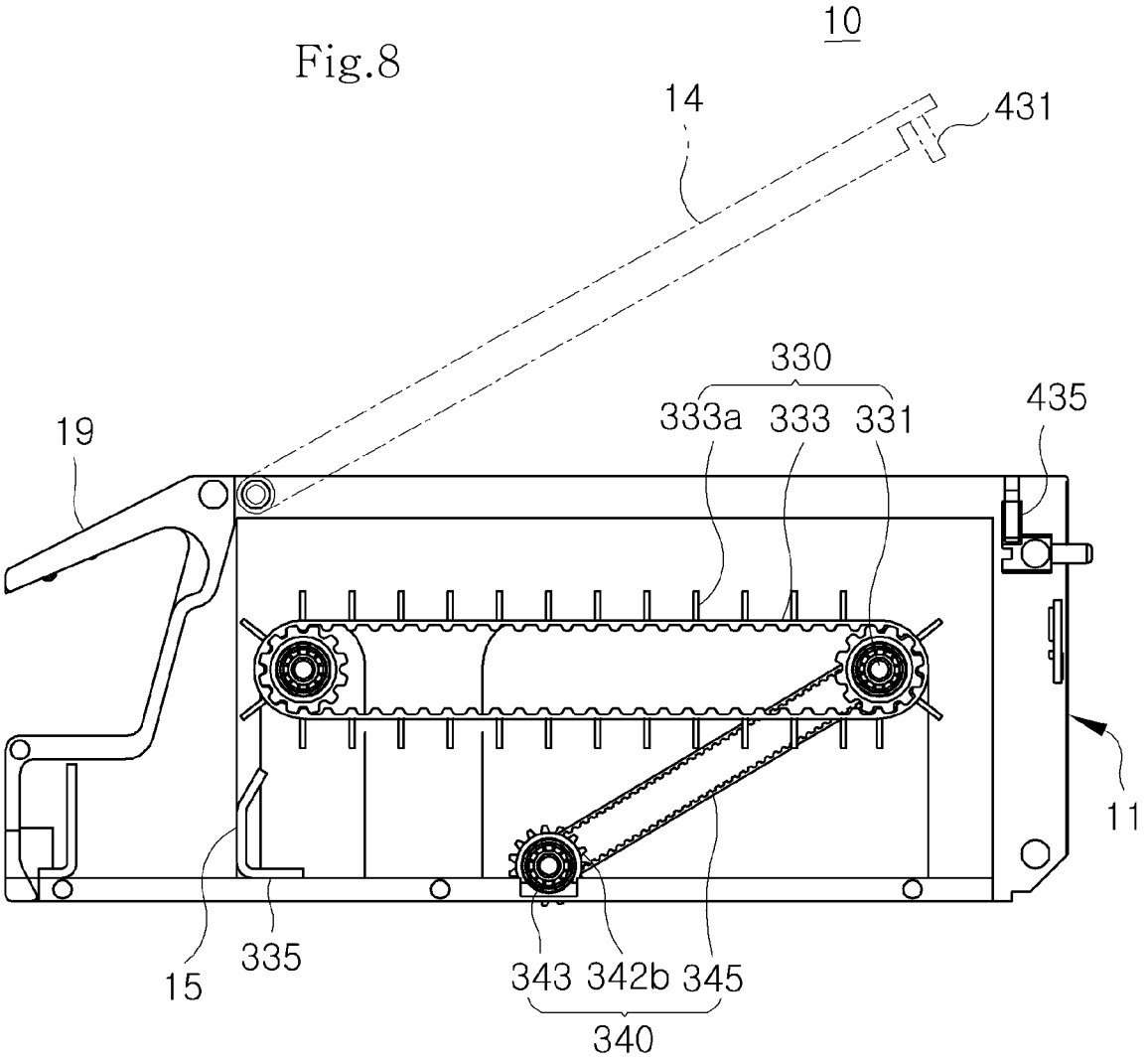
FIG. 8 is a side sectional view illustrating the medicine cartridge of the medicine feeding apparatus according to a second embodiment of the present invention.
Figure 9:
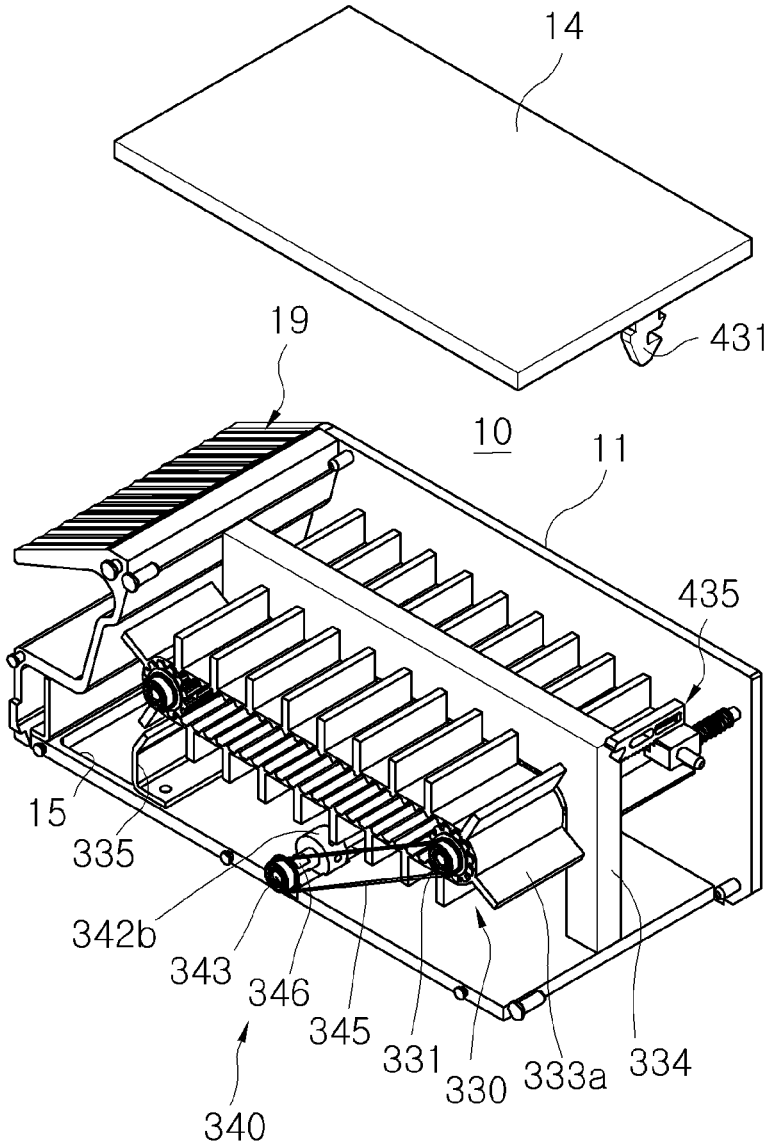
FIG. 9 is a view illustrating the interior of the medicine cartridge of the medicine feeding apparatus according to the second embodiment of the present invention.
Figure 10:
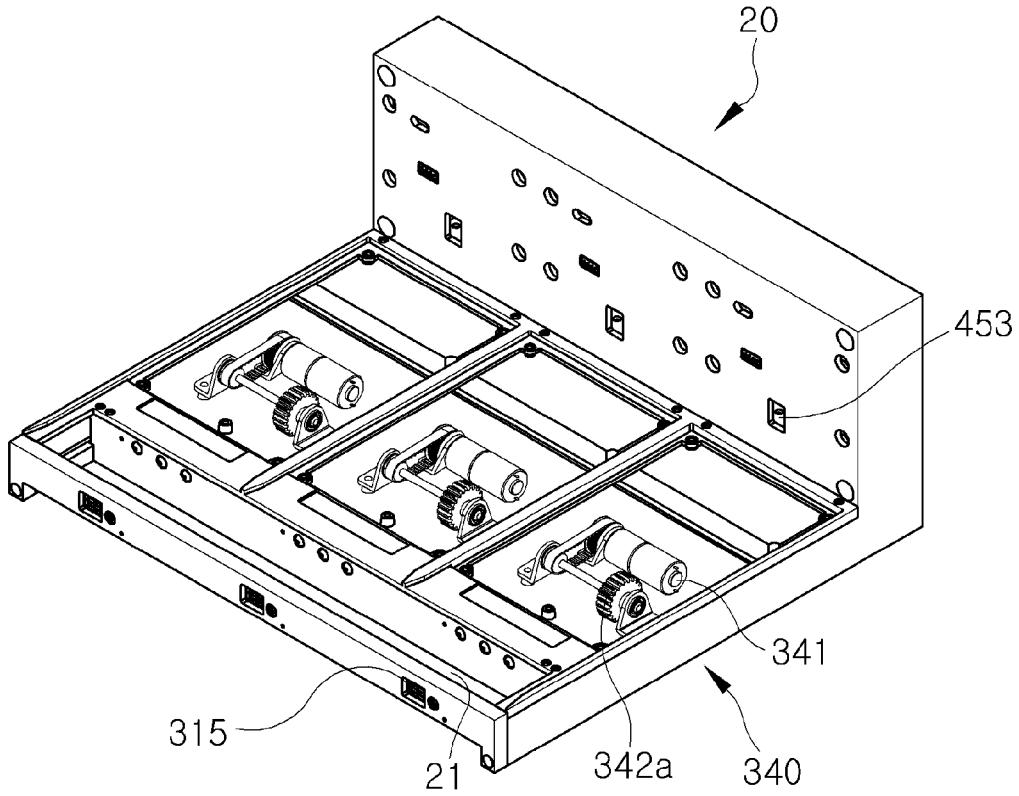
FIG. 10 is a view illustrating the cartridge mount of the medicine feeding apparatus according to the second embodiment of the present invention.

FIG. 8 is a side sectional view illustrating the medicine cartridge of the medicine feeding apparatus according to a second embodiment of the present invention, FIG. 9 is a view illustrating the interior of the medicine cartridge of the medicine feeding apparatus according to the second embodiment of the present invention, and FIG. 10 is a view illustrating the cartridge mount of the medicine feeding apparatus according to the second embodiment of the present invention.

A medicine discharge mechanism 330 according to the second embodiment, as illustrated, allows the medicine products M to be accommodated respectively in independent spaces. To this end, the medicine discharge mechanism 330 includes front and rear rotating shafts 331 installed to connect opposite lateral surfaces of the cartridge body 11 to each other, and a partitioned conveyor belt 333 rotatably engaged with the front and rear rotating shafts 331 to connect the front and rear rotating shafts 331 to each other.

Here, the front rotating shaft 331 located toward the front surface of the cartridge body 11 is preferably located above the discharge hole 15. This allows medicine products seated on the partitioned conveyor belt 333 to fall through the discharge hole 15 as the partitioned conveyor belt 333 is turned downward when being rotated around the rotating shaft 331 located near the discharge hole 15.

The partitioned conveyor belt 333 is configured such that the medicine products M are seated on an upper surface of the partitioned conveyor belt 333. Thus, to define independent accommodating spaces on a per medicine product basis, a plurality of partition members 333*a* is preferably equidistantly arranged in parallel to the rotating shaft 331 on the upper surface of the partitioned conveyor belt 333.

The partitioned conveyor belt 333, as illustrated in FIG. 9, may be longitudinally divided into two parts based on the size of the medicine products to be seated thereon.

In the case of long medicine products, such as syringes containing an injection, the medicine products may be accommodated in the independent accommodating spaces defined by the partition members 333*a* so as to be discharged through the discharge hole 15 when the partitioned conveyor belt 333 is rotated.

Also, in the case of medicine products having a low volume and short length, such as pouch type medicine products, PTP type medicine products, ampoules, or vials, the partitioned conveyor belt 333 may be longitudinally divided into two parts to allow an increased number of medicine products to be accommodated in a single medicine cartridge 10.

In the case where the partitioned conveyor belt 333 is divided into two partitioned conveyor belts, an intermediate partition member 334 may be installed between one partitioned conveyor belt and the other partitioned conveyor belt to prevent the medicine products seated on one partitioned conveyor belt from interfering with the medicine products seated on the other partitioned conveyor belt.

Preferably, the intermediate partition member 334 is installed to come into contact with the front and rear surfaces of the cartridge body 11 so as not to interfere with operation of the rotating shafts 331 and the partitioned conveyor belts 333 while intercepting communication between upper surfaces of the two partitioned conveyor belts 333.

Also, the intermediate partition member 334 comes into contact at opposite surfaces thereof with the partition members 333*a* without a separate coupling means. Thus, it will be appreciated that the intermediate partition member 334 is detachably installed within the cartridge body 11 so as to be selectively used as necessary.

In the present embodiment, the partition members 333*a* arranged on the upper surface of one partitioned conveyor belt may be alternately arranged with the partition members 333*a* arranged on the upper surface of the other partitioned conveyor belt.

More specifically, assuming that the partition members on one partitioned conveyor belt and the partition members on the other partitioned conveyor belt are aligned, the medicine products seated on both the partitioned conveyor belts 333 simultaneously fall through the discharge hole 15 via rotation of the rotating shafts 331. This can be employed when it is desired to discharge one or more medicine products simultaneously.

Also, assuming that the partition members on one partitioned conveyor belt are alternately arranged with the partition members on the other partitioned conveyor belt, the medicine product on one partitioned conveyor belt falls through the discharge hole, but the medicine product on the other partitioned conveyor belt are caught by the partition members 333*a* so as not to be discharged.

Thus, the two partitioned conveyor belts can be operated to alternately discharge the medicine products one by one. Of course, this configuration can be selectively employed by the user as necessary.

In the present embodiment, additionally, a discharge guide member 335 is provided at one side of the discharge hole perforated in a front position of the bottom of the cartridge body 11. The discharge guide member 335 has an upper end bent toward the partition member 333*a*, thereby serving to guide the medicine products accommodated between the partition member 333*a* to fall through the discharge hole 15.

In the present embodiment, a discharge drive mechanism 340 to drive the medicine discharge mechanism 330 having the above described configuration, as illustrated in FIG. 10, serves to discharge the medicine products seated on the upper surface of the partitioned conveyor belt 333 to the discharge hole 15 by rotating the rotating shafts 331. The discharge drive mechanism 340 includes a discharge drive unit 341 installed in the cartridge mount 20, a discharge driving gear 342*a* installed in the cartridge mount 20 such that an upper portion thereof is exposed from the upper surface of the cartridge mount 20, a discharge driven gear 342*b* engaged with and rotated by the discharge driving gear 342*a* that is driven by the discharge drive unit 341, a rotation drive shaft member 343 installed to the discharge driven gear 342*b* so as to be rotated along with the discharge driven gear 342*b*, and a rotation drive belt 345 connecting the rotation drive shaft member 342 and the rotating shafts 331 to each other so as to rotate the rotating shafts 331.

Specifically, if the medicine cartridge 10 is mounted on the cartridge mount 20 and the discharge drive unit 341 is driven to discharge the medicine products, the discharge driving gear 342*a* is rotated by the discharge drive unit 341 and simultaneously, the discharge driven gear 342*b* engaged with the discharge driving gear 342*a* is rotated. Thereby, the rotation drive shaft member 343, to which with the discharge driven gear 342*b* is connected, is rotated, causing the rotating shaft 331 connected to the rotation drive belt 345 is rotated. As such, the partitioned conveyor belt 333 is rotated via rotation of the rotating shaft 331.

Then, as the partitioned conveyor belt 333 is turned downward when being rotated around the rotating shaft 331 located toward the front surface of the cartridge body 11, the medicine products accommodated between the partition members 333*a* arranged on the upper surface of the partitioned conveyor belt 333 are discharged to the discharge hole 15 along the discharge guide member 335, the upper end of which is bent toward the partitioned conveyor belt 333.

Here, a partition member position sensor 346 is installed to the rotation drive shaft member 343 to sense a position of the partition member 333*a*.

The partition member position sensor 346 installed to the rotation drive shaft member 343 is located below the partitioned conveyor belt 333 and serves to sense the position of the partition member 333*a* and send a drive signal to the discharge drive unit 341.

The discharge drive unit 341 is driven upon receiving the sensed signal from the partition member position sensor 346.

In this case, assuming that the partitioned conveyor belt 333 is longitudinally divided into two partitioned conveyor belts, the two partitioned conveyor belts 333 are arranged such that the partition members 333*a* on one partitioned conveyor belt 333 are alternately arranged with the partition members 333*a* on the other partitioned conveyor belt 333, which allows the medicine products seated on the two partitioned conveyor belts 333 to be discharged one by one.

The discharge drive unit 341 is driven at a preset interval conforming to a distance between the partition member on one partitioned conveyor belt and the partition member on the other partitioned conveyor belt, such that the medicine products on one partitioned conveyor belt can be kept seated when the medicine products on the other partitioned conveyor belt are discharged.

As described above, the medicine discharge mechanism 330 is provided with the discharge sensor 315 to sense whether or not the medicine products are discharged through the discharge hole 15 of the medicine cartridge 10. Sensing the medicine products discharged from the medicine cartridge 10 using the discharge sensor 315 allows calculation of the number of the discharged medicine products and accurate estimation of the time when medicine products need to be added.

Figure 11:
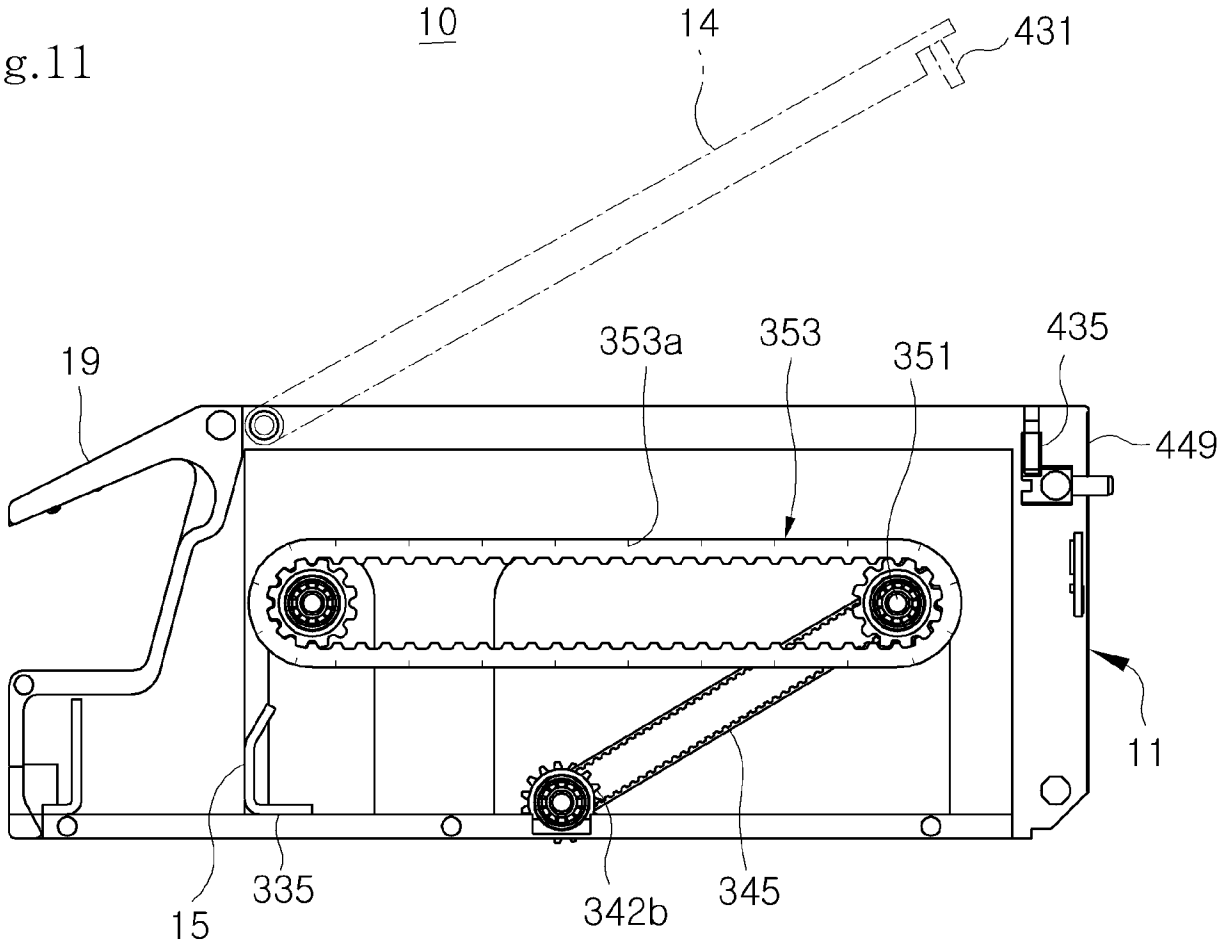
FIG. 11 is a side sectional view illustrating the medicine cartridge of the medicine feeding apparatus according to a third embodiment of the present invention.
Figure 12:
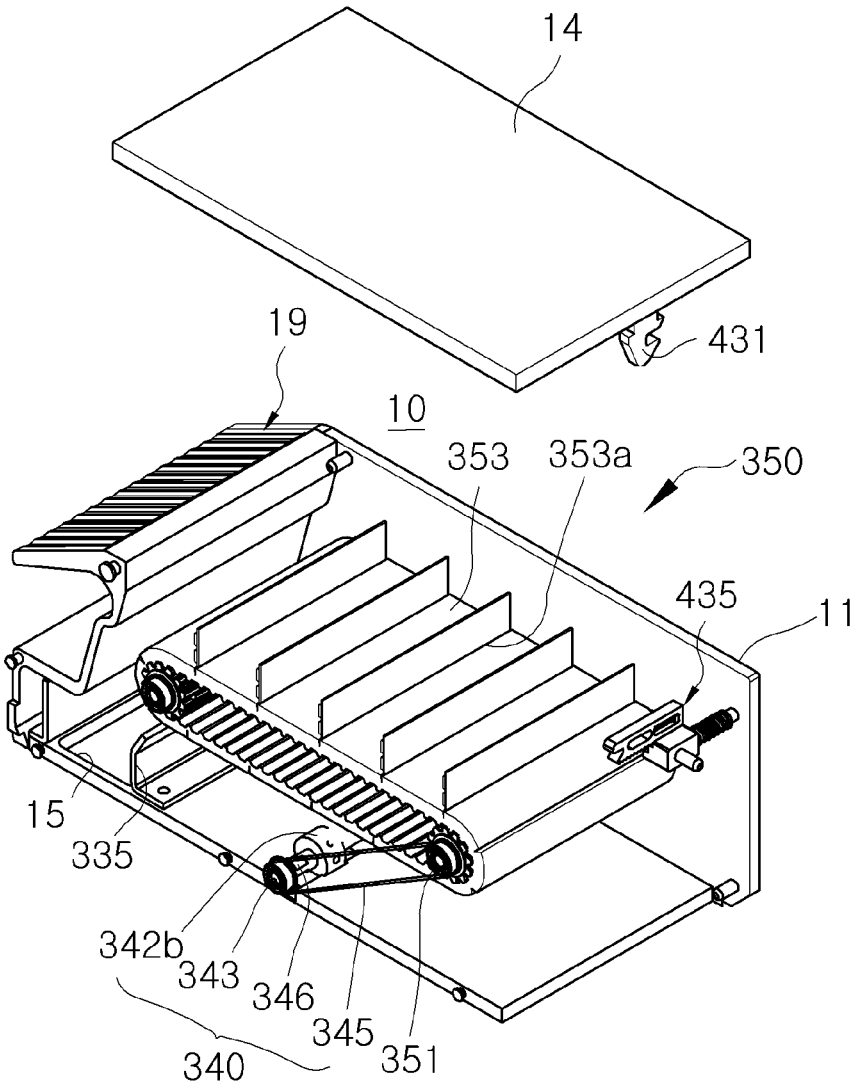
FIG. 12 is a view illustrating the interior of the medicine cartridge of the medicine feeding apparatus according to the third embodiment of the present invention.
Figure 13:
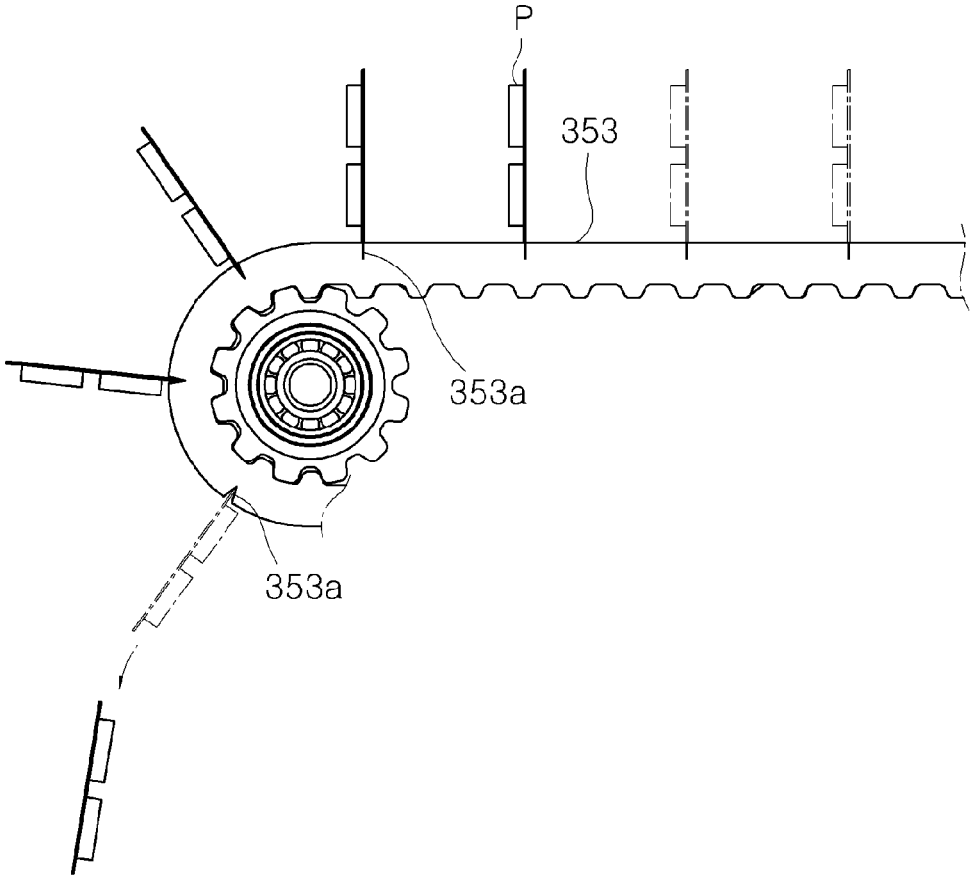
FIG. 13 is a view illustrating operation of a medicine discharge mechanism of the medicine feeding apparatus according to the third embodiment of the present invention.

FIG. 11 is a side sectional view illustrating the medicine cartridge of the medicine feeding apparatus according to a third embodiment of the present invention, FIG. 12 is a view illustrating the interior of the medicine cartridge of the medicine feeding apparatus according to the third embodiment of the present invention, and FIG. 13 is a view illustrating operation of a medicine discharge mechanism of the medicine feeding apparatus according to the third embodiment of the present invention.

As illustrated, a medicine discharge mechanism 350 according to the present embodiment includes front and rear rotating shafts 351 installed to connect opposite lateral surfaces of the cartridge body 11 to each other, and a slit conveyor belt 353 rotatably engaged with the front and rear rotating shafts 351 to connect the front and rear rotating shafts 351 to each other.

Here, the front rotating shaft 351 located toward the front surface of the cartridge body 11 is preferably located above the discharge hole 15. This allows medicine products seated on the slit conveyor belt 353 to fall through the discharge hole 15 as the slit conveyor belt 353 is turned downward when being rotated around the rotating shaft 351 located near the discharge hole 15.

As illustrated in FIG. 12, the slit conveyor belt 353 is configured such that one end of each medicine product is secured to an upper surface of the slit conveyor belt 353. To this end, the slit conveyor belt 353 includes slits 353*a* equidistantly arranged at the upper surface thereof such that one end of the medicine product is inserted into and secured to each slit 353*a*. The slits 353*a* are formed by cutting a part of the upper surface, rather than cutting the slit conveyor belt 353.

The slit conveyor belt 353 is made of an elastic material. Thus, when one end of the medicine product is inserted into the slit 353*a*, opposite surfaces of the medicine product come into contact with the slit conveyor belt 353 and the medicine product is kept in a fixed position. The medicine product to be inserted into the slit 353*a* may be a pouch type medicine product P, and all the medicine products P may be individually kept in fixed positions within the medicine cartridge 10 so as not to interfere with one another.

In the present embodiment, as the pouch type medicine products are inserted into the slits 353*a* of the slit conveyor belt 353 without a risk of interference therebetween, it is possible to prevent damage to the medicine products P.

Additionally, similar to the above described second embodiment, the slit conveyor belt 353 may be further provided with the intermediate partition member such that the slit conveyor belt 353 is divided into two slit conveyor belts, and the slits of one slit conveyor belt may be alternately arranged with the slits of the other slit conveyor belt to ensure that a greater number of medicine products can be accommodated on the slit conveyor belt 353.

The present embodiment employs the same discharge drive mechanism as the discharge drive mechanism 340 to drive the medicine discharge mechanism 330 of the above described second embodiment as illustrated in FIG. 10 and thus, a detailed description thereof will be omitted.

If the medicine cartridge 10 is mounted on the cartridge mount 20 and the discharge drive unit 341 is driven to discharge the medicine products, the discharge driving gear 342*a* is rotated by the discharge drive unit 341 and simultaneously, the discharge driven gear 342*b* engaged with the discharge driving gear 342*a* is rotated. Thereby, the rotation drive shaft member 343, to which the discharge driven gear 342*b* is connected, is rotated, causing the rotating shaft 351 connected to the slit conveyor belt 353 to be rotated. As such, the slit conveyor belt 353 is rotated.

Then, as the slit conveyor belt 353 is turned downward when being rotated around the rotating shaft 351 located toward the front surface of the cartridge body 11, as illustrated in FIG. 13, the slit 353*a* is elastically expanded in opposite directions, thereby allowing the medicine product P inserted into the slit 353*a* to be released from the slit 35*a* so as to fall through the discharge hole 15.

Similar to the above described medicine cartridge of the second embodiment, the discharge guide member 335 is provided at one side of the discharge hole 15 perforated in the front position of the bottom of the cartridge body 11 such that the upper end thereof is bent toward the slit conveyor belt 353 to guide the medicine product released from the slit 353*a* to fall through the discharge hole 15.

Figure 14:
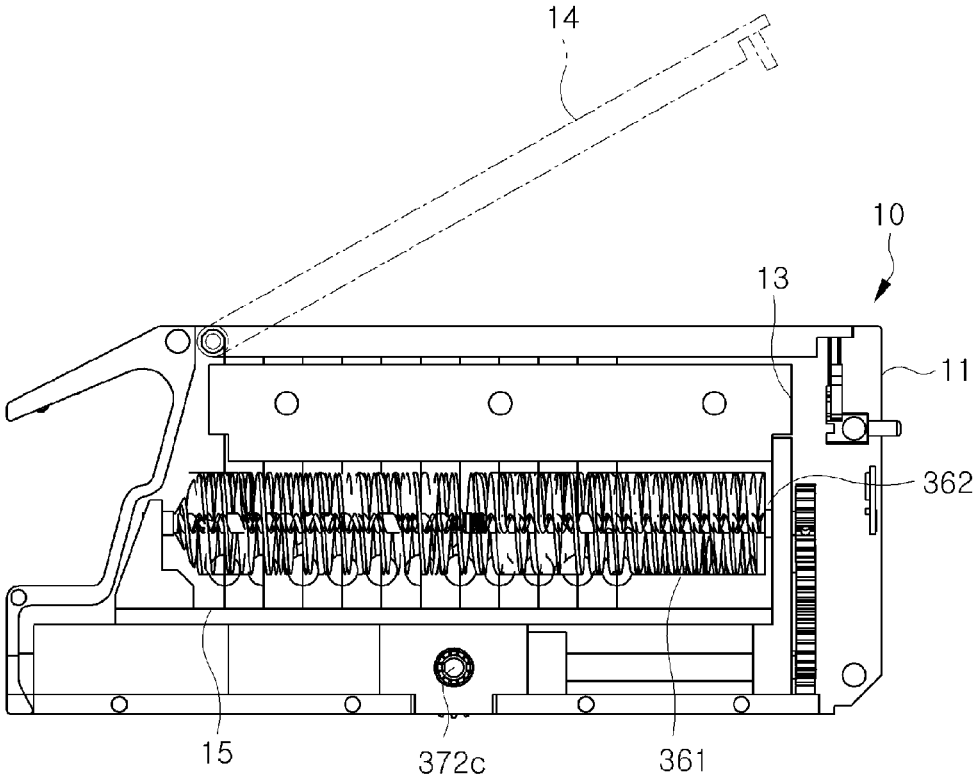
FIG. 14 is a side sectional view illustrating the medicine cartridge of the medicine feeding apparatus according to a fourth embodiment of the present invention.
Figure 15:
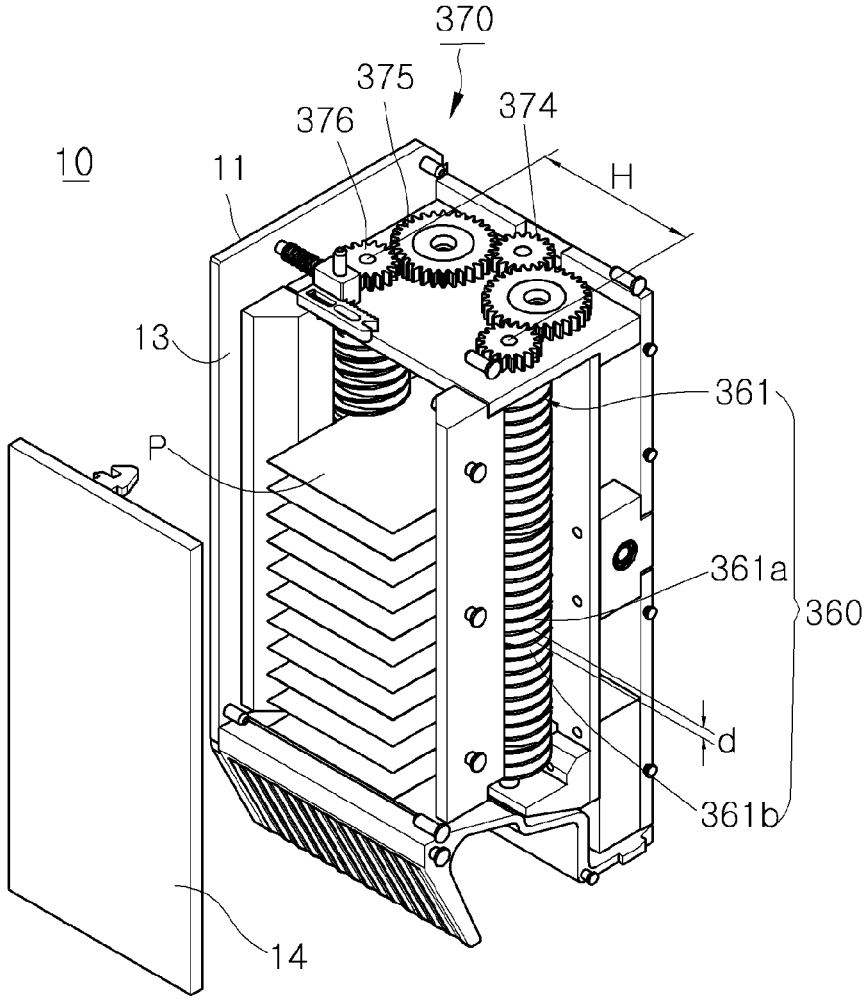
FIG. 15 is a view illustrating the medicine cartridge, from which a cover is separated, according to the fourth embodiment of the present invention.

FIG. 14 is a side sectional view illustrating the medicine cartridge of the medicine feeding apparatus according to a fourth embodiment of the present invention, and FIG. 15 is a view illustrating the medicine cartridge, from which a cover is separated, according to the fourth embodiment of the present invention.

Figure 16:
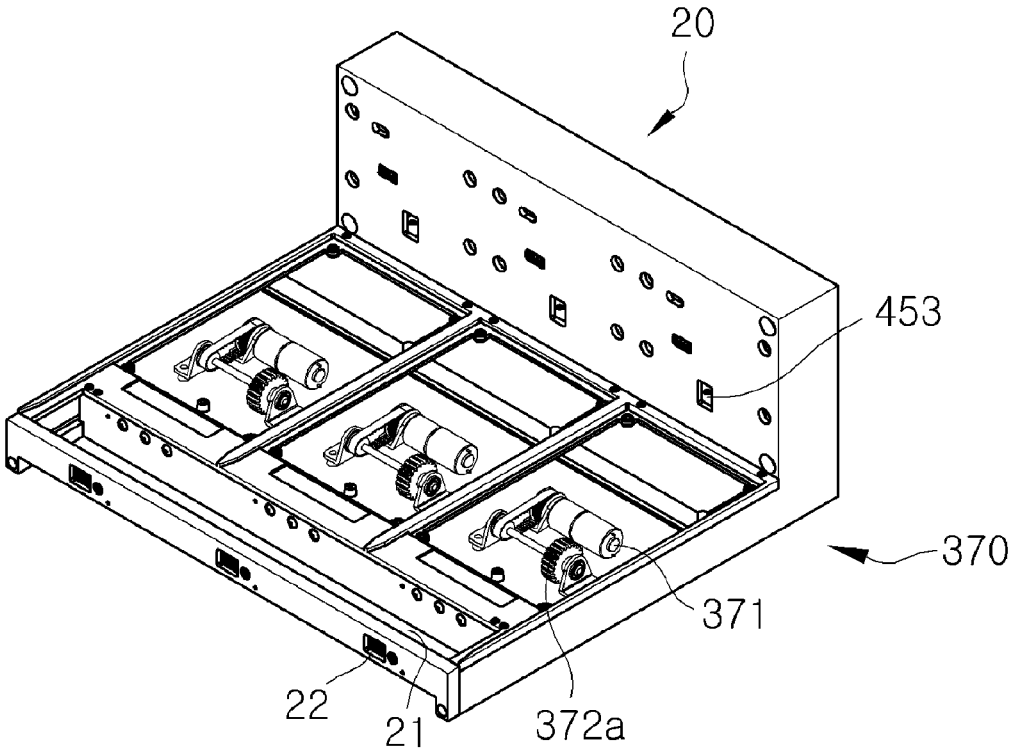
FIG. 16 is a view illustrating the cartridge mount of the medicine feeding apparatus according to the fourth embodiment of the present invention.
Figure 17:
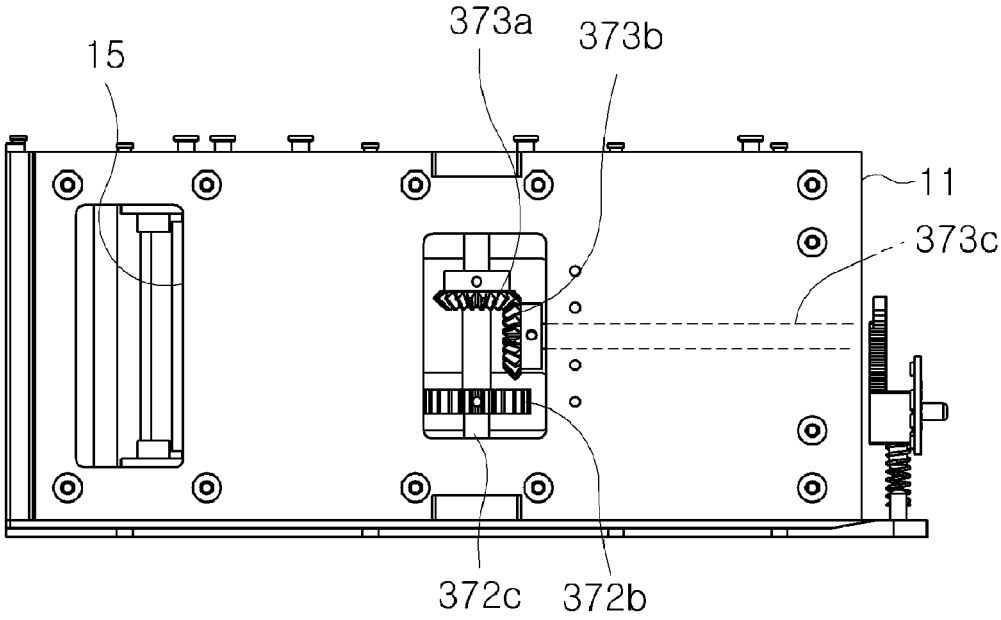
FIG. 17 is a bottom view illustrating the medicine cartridge according to the fourth embodiment of the present invention.

FIG. 16 is a view illustrating the cartridge mount of the medicine feeding apparatus according to the fourth embodiment of the present invention, and FIG. 17 is a bottom view illustrating the medicine cartridge according to the fourth embodiment of the present invention.

A medicine discharge mechanism 360 according to the present embodiment may include a pair of screw members 361 installed in opposite sides of the cartridge body 11. The screw members 361 may be placed on rotating shaft members 362 that are rotated by a discharge drive mechanism 370.

The screw member 361 is provided at an outer surface thereof with screw threads 361*a* and 361*b*, and the neighboring screw threads 361*a* and 361*b* define a slot therebetween. Thus, as both ends of the medicine product P are inserted into the slots between the screw threads 361*a* and 361*b* of the pair of screw members 361, it is possible to prevent neighboring medicine products from coming into contact with each other.

In this case, the medicine product inserted between the screw threads of the screw member may be a pouch type or PTP type medicine product, and preferably has a thickness suitable to be introduced into the slot between the screw threads.

Referring to FIG. 15, a distance H between the two screw members 361 may be adjusted to match the size of the medicine product because it is necessary to insert both ends of the medicine product into the screw threads 361*a* and 361*b* of the screw members 361. More specifically, the distance H between the screw members 361 is increased if the medicine product is large, and is reduced if the medicine product is small.

Also, a distance d between the screw threads 361*a* and 361*b* is preferably equal to a thickness of the medicine product P. More specifically, the distance d between the screw threads 361*a* and 361*b* is increased if the medicine product is thick, and is reduced if the medicine product is thin, which ensures that the medicine product can be stably inserted between the screw threads.

That is, the medicine product P accommodated in the medicine cartridge 10 is located between the screw members 361 and is inserted into a space between the screw threads 361*a* and 361*b* of the screw members 361.

In the present embodiment, as both ends of the medicine product P are inserted between the screw threads, the medicine products P are accommodated respectively in independent spaces, which can prevent damage to the medicine products P due to collision between the medicine products within the medicine cartridge 10.

The above described screw members 361 are rotated by the rotating shaft members 362 inserted therethrough, and the rotating shaft members 362 are rotated by the discharge drive mechanism 370. As illustrated in FIG. 16, the discharge drive mechanism 370 includes a discharge drive unit 371 installed in the cartridge mount 20, a discharge driving gear 372*a* to be driven by the discharge drive unit 371, helical gears 373*a* and 373*b* to change a rotating direction of the discharge driving gear 372*a*, a discharge driven gear 372*b* to be rotated in linkage with the helical gears 373*a* and 373*b*, and a rotation driving gear 374 and rotation driven gears 375 to be rotated in linkage with the discharge driven gear 372*a*.

The discharge drive unit 371 is installed in the cartridge mount 20. The discharge driving gear 372*a* to be driven by the discharge drive unit 371 is installed at one side of the discharge drive unit 371 such that an upper portion thereof is exposed from the upper surface of the cartridge mount 20.

Referring to FIG. 17, the discharge driven gear 372*b* is installed at the bottom of the medicine cartridge 10 so as to be engaged with and rotated by the discharge driving gear 372*a*. The discharge driven gear 372*b* is placed on a discharge shaft member 372*c* parallel to the front surface of the medicine cartridge 10 so as to rotate the discharge shaft member 372*c*.

An end of the discharge shaft member 372*c* is provided with the first helical gear 373*a*. The first helical gear 373*a* changes a rotating direction of the discharge driven gear 372*b* by a right angle. The second helical gear 373*b* is engaged at a right angle with the first helical gear 373*a*.

The second helical gear 373*b* is placed on the rotation drive shaft member 373*c* and in turn, the rotation drive shaft member 373*c* is connected to the rear surface of the medicine cartridge 10.

Referring again to FIG. 15, the rotation driving gear 374 is placed on an end of the rotation drive shaft member 373*c* located at the rear surface of the medicine cartage 10.

The rotation driven gears 375 are provided at opposite sides of the rotation driving gear 374 and are engaged with rotating screw gears 376 placed on the rotating shaft members 362.

If the discharge drive unit 371 is driven, the discharge driving gear 372*a* is rotated and simultaneously, the discharge driven gear 372*b* installed at the bottom of the medicine cartridge 10 is rotated, causing the discharge shaft member 372*c* to be rotated.

Thereby, as illustrated in FIG. 17, the first helical gear 373*a* installed to the discharge shaft member 373*c* is rotated, and the second helical gear 373*b* engaged at a right angle with the first helical gear 373*a* is rotated, causing the rotation drive shaft member 373*c* to be rotated.

If the rotation drive shaft member 373*c* is rotated, the rotation driving gear 374 is rotated, causing the rotating screw gears 376 placed on the rotating shaft members 362 to be rotated via the rotation driven gear 375. As such, the screw members 361 placed on the rotating shaft members 362 are rotated.

In this case, the discharge drive unit 371 preferably rotates the screw members 361 to discharge the medicine products P at an interval corresponding to the distance d between the screw threads 361*a* and 361*b* of the screw members 361.

More specifically, if the discharge drive unit 371 is driven to rotate the screw members 361, the medicine products P inserted between the screw threads 361*a* and 361*b* are moved forward based on a rotating direction of the screw threads 361*a* and 361*b*. The forwardly moved medicine products P are discharged from the medicine cartridge 10 through the discharge hole 15 formed in the front position of the medicine cartridge 10.

Thus, if the distance between the screw threads 361*a* and 361*b* provides a wide gap, the screw members 361 need to be further rotated to ensure normal discharge of the medicine products P inserted into the wide gap between the screw threads 361*a* and 361*b*. Of course, the driving speed of the discharge drive unit 371 may be controlled to adjust the discharge speed of the medicine products P.

Figure 18:
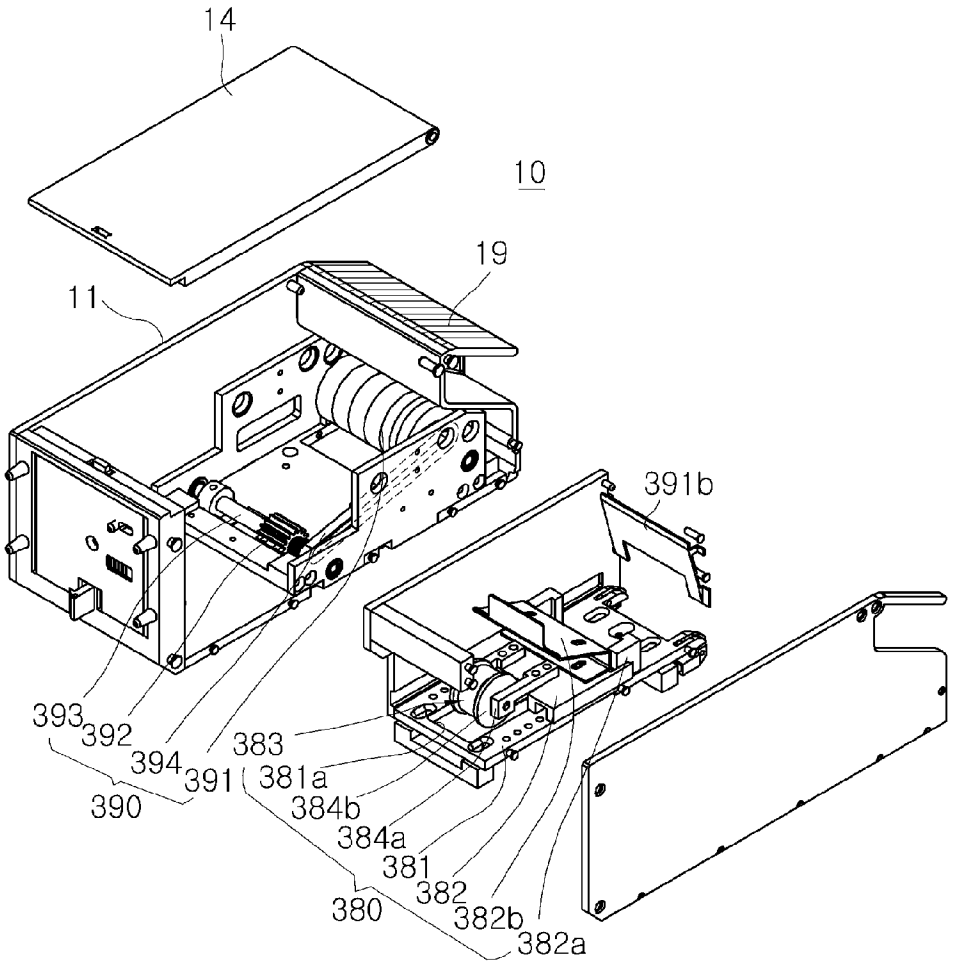
FIG. 18 is an exploded perspective view of the medicine cartridge of the medicine feeding apparatus according to a fifth embodiment of the present invention.
Figure 19:
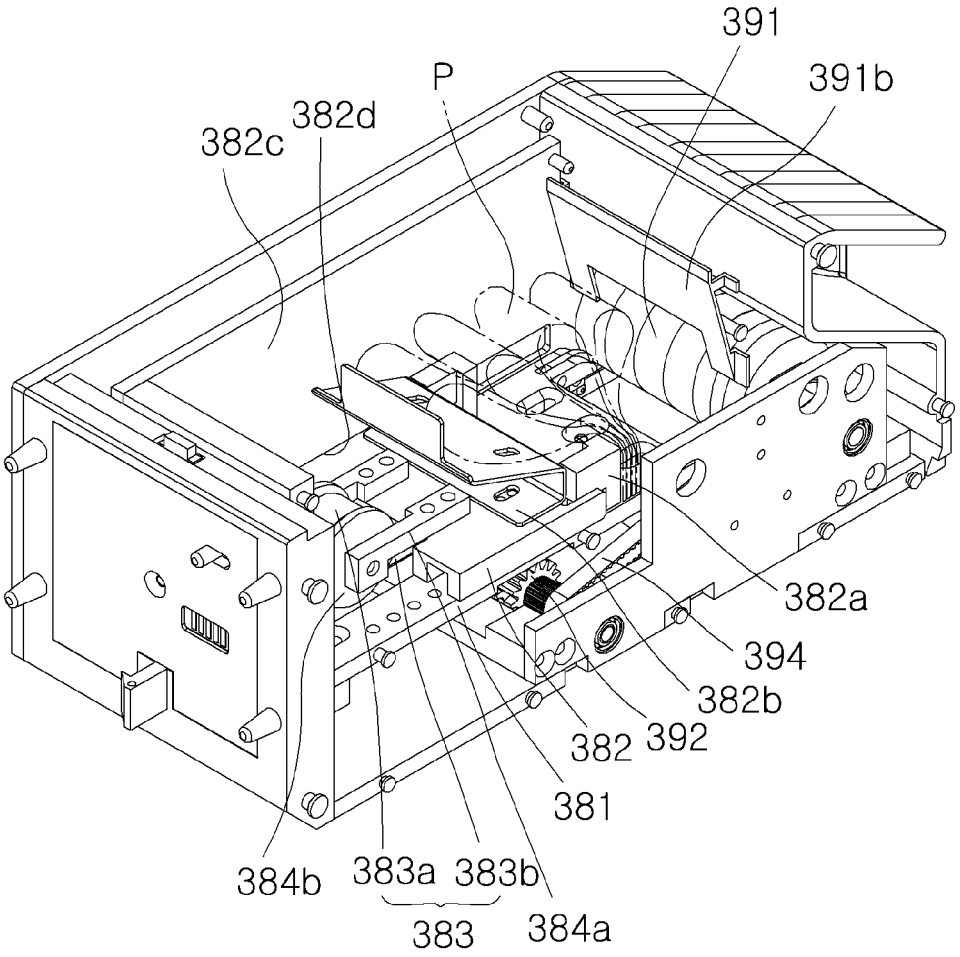
FIG. 19 is a view illustrating the interior of the medicine cartridge according to the fifth embodiment of the present invention.

FIG. 18 is an exploded perspective view of the medicine cartridge of the medicine feeding apparatus according to a fifth embodiment of the present invention, and FIG. 19 is a view illustrating the interior of the medicine cartridge according to the fifth embodiment of the present invention.

Figure 20:
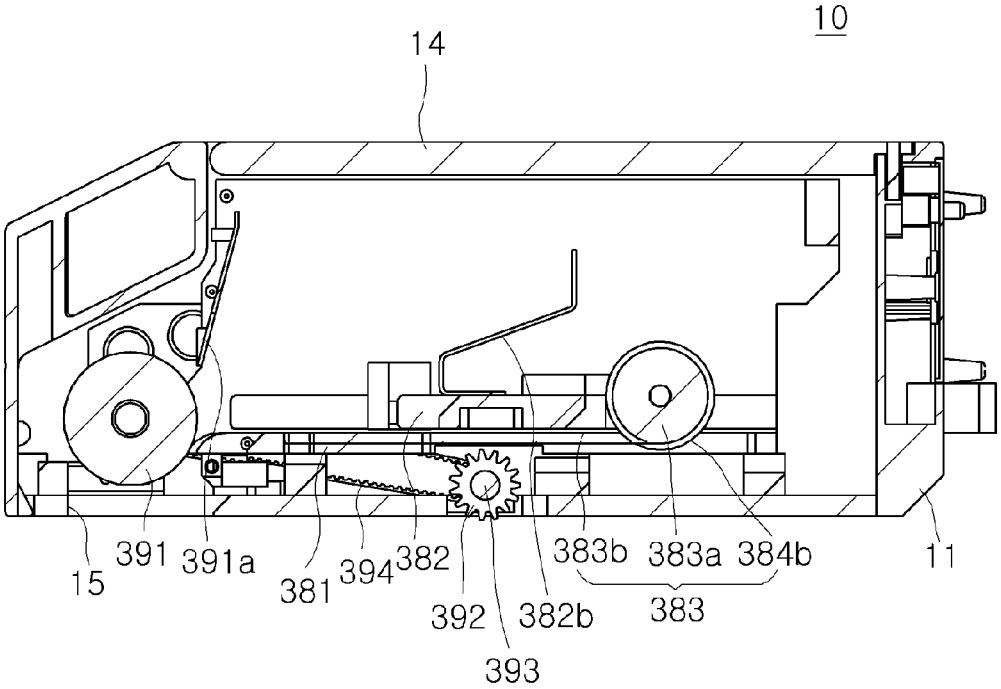
FIG. 20 is a side sectional view of the medicine cartridge according to the fifth embodiment of the present invention.
Figure 21:
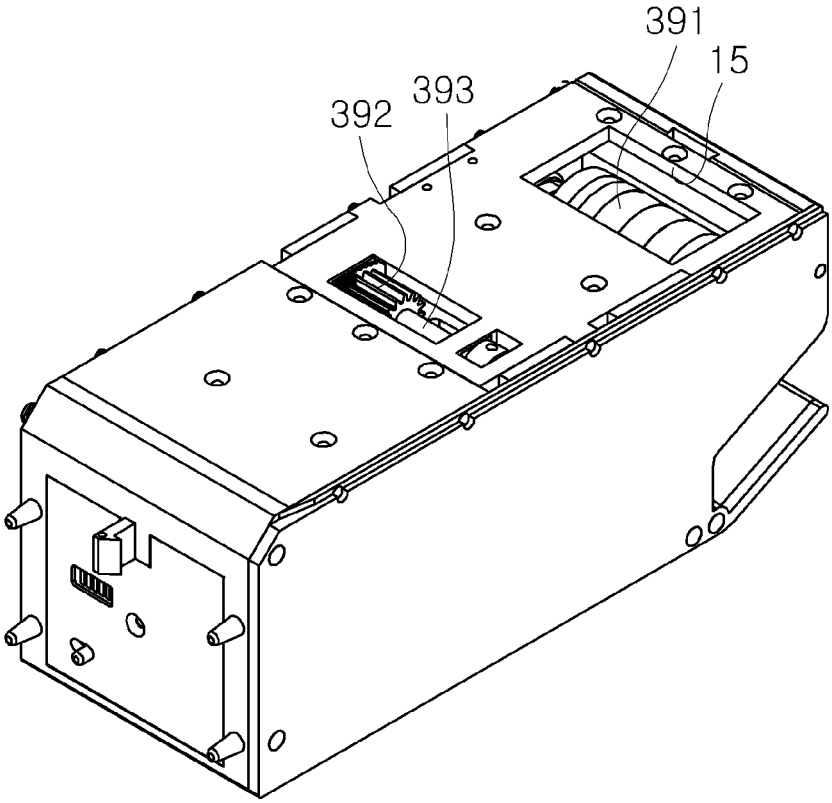
FIG. 21 is a rear perspective view of the medicine cartridge according to the fifth embodiment of the present invention.

FIG. 20 is a side sectional view of the medicine cartridge according to the fifth embodiment of the present invention, and FIG. 21 is a rear perspective view of the medicine cartridge according to the fifth embodiment of the present invention.

As illustrated, a medicine discharge mechanism 380 according to the present embodiment is installed in the cartridge body 11 to push the medicine products P accommodated in the cartridge body 11 to the discharge hole 15. In addition, a discharge drive mechanism 390 is installed to the medicine cartridge 10 and the cartridge mount 20 to drive the medicine discharge mechanism 380 so as to enable discharge of the medicine products P through the discharge hole 15.

The medicine discharge mechanism 380 includes a bottom member 381 spaced apart from the bottom surface of the cartridge body 11, a moving member 382 having opposite lower ends seated on opposite sides of the bottom member 381, a support member 382*a* provided at a front surface of the moving member 382 so as to come into contact with the medicine product accommodated in the cartridge body 11, and a movable elastic member 383 installed to the moving member 382 so as to push or pull the moving member 382 toward or from the discharge hole 15.

The bottom member 381 is provided at a front position thereof with an opening through which the discharge hole 15 is exposed and at a rear position thereof with a bottom hole 381*a* through which the movable elastic member 383 is exposed to come into contact with the bottom surface of the cartridge body 11. The bottom member 381 may have an II-shaped form such that opposite lower ends of the moving member 382 are seated thereon.

As illustrated in FIG. 19, the moving member 382, opposite lower ends of which are seated on the bottom member 381, is movable forward of the bottom member 381, i.e. toward the discharge hole 15, or rearward of the bottom member 381.

Here, the movable elastic member 383 to move the moving member 382, as illustrated in FIG. 20, includes a winding roll 383*a* and an elastic piece 383*b* integrally placed on the winding roll 383*a* so as to be wound on or unwound from the winding roll 383*a*.

In this case, the elastic piece 383*b* is elastically wound and can be restored to an original shape thereof when being unwound. The elastic piece 383*b* is inserted from the rear side of the bottom member 381 to thereby be wound on the winding roll 383*a*.

Both sides of the winding roll 383*a* are rotatably caught by the moving member 382 via connecting members 384*a*.

Preferably, winding guide members 384*b* are connected to both sides of the winding roll 383*a* and have a greater diameter than a diameter of the winding roll 383*a* to ensure that the elastic piece 383*b* is uniformly and stably wound between the winding guide members 384*b*.

In addition, a medicine accommodation guide member 382*b* is installed at a right angle to the moving member 382. An upper end of the medicine accommodation guide member 382*b* is bent rearward of the cartridge body 11.

In addition, a movement guide member 382*c* having a movement guide groove 382*d* is installed to vertically extend from one side of the bottom member 381 such that one side of the moving member 382 is inserted into the movement guide groove 382*d*. As the moving member 382 is moved forward or rearward of the medicine cartridge 10 in a state in which one end of the moving member 382 is inserted into the movement guide groove 382*d*, movement of the moving member 382 can be stably guided.

If the elastic piece 383*b* is wound on the winding roll 383*a* via rotation of the winding roll 383*a*, the winding roll 383*a* is rotated and moved toward the bottom member 381, causing the moving member 382 connected to the winding roll 383*a* via the connecting members 384*a* to be moved toward the discharge hole 15. Thereby, the moving member 382 acts to push the medicine products P caught by the support member 382*a* toward the discharge hole 15.

In the case where the user manually puts the medicine products into the cartridge body 11, as the user pushes the moving member 32 rearward of the medicine cartridge 10, the elastic piece 383*b* of the movable elastic member 383 is unwound from the winding roll 33*a* and is spread.

Then, the user locates one end of the medicine product between the support member 382*a* and the discharge hole 15 and thereafter, removes pressure applied to the moving member 382 that has been pushed rearward of the medicine cartridge 10.

Thereby, as the elastic piece 383*b* is wound on the winding roll 383*a*, the moving member 382 is moved toward the discharge hole 15, allowing the medicine product to be accommodated between the support member 382*a* and a discharge roller member 391.

In this case, as the end of the medicine product is located between the support member 382*a* and the discharge roller member 391 of the discharge drive mechanism 390, e.g., tablets or medicinal powder received in the medicine product is likely to be moved upward, which needs a larger upper space between the support member 382*a* and the discharge roller member 391. However, with the use of the medicine accommodation guide member 382*b*, the upper end of which is bent rearward of the medicine cartridge 10, it is possible to prevent the medicine product from deviating from the moving member 382.

As illustrated in FIG. 21, the discharge drive mechanism 390 serves to drive the discharge roller member 391 installed to the inner front surface of the cartridge body 11 so as to be located above the discharge hole 15. If the medicine product P is moved to the discharge hole 15 by the moving member 382 so as to come into contact with the discharge roller member 391, the discharge roller member 391 discharges the medicine product P through the discharge hole 15. The discharge drive mechanism 390 includes a discharge drive unit (not shown) installed in the cartridge mount 20, a discharge driving gear (not shown) installed to be driven by the discharge drive unit such that an upper portion of which is exposed from the upper surface of the cartridge mount 20, a discharge driven gear 392 installed at the bottom of the medicine cartridge 10 and engaged with and rotated by the discharge driving gear, a rotation drive shaft member 393 rotatably connected to the discharge driven gear 392, and a discharge drive belt 394 connecting the rotation drive shaft member 393 and a rotating shaft of the discharge roller member 391 to each other.

Here, the discharge driving unit and the discharge driving gear have the same configuration as those of the above described fourth embodiment and thus, a detailed description thereof will be omitted.

If the medicine cartridge 10 is mounted on the cartridge mount 20 and the discharge drive unit is driven to discharge the medicine products, the discharge driving gear is rotated by the discharge drive unit and simultaneously, the discharge driven gear 392 engaged with the discharge driving gear is rotated, causing the rotation drive shaft member 393 connected to the discharge driven gear 392 to be rotated. As the rotation drive shaft member 393 is rotated, the discharge roller member 391 connected to the discharge drive belt 394 is rotated.

In this case, the discharge roller member 391 is rotated and moved downward, thereby acting to push the medicine product P toward the discharge hole 15 while coming into contact with one surface of the medicine product P. As such, the medicine product P is discharged through the discharge hole 15.

Here, the discharge roller member 391 is preferably made of an elastic material to prevent damage to the medicine product P because it is rotated in contact with the medicine product P.

In addition, a discharge guide member 391*a* is installed to the inner front surface of the medicine cartridge 10 to cover an upper portion of the discharge roller member 391 such that a part of the discharge roller member 391 to come into contact with the medicine product P is exposed. Thus, the discharge guide member 391*a* serves to guide the contact region between the discharge roller member 391 and the medicine product P.

Figure 22:
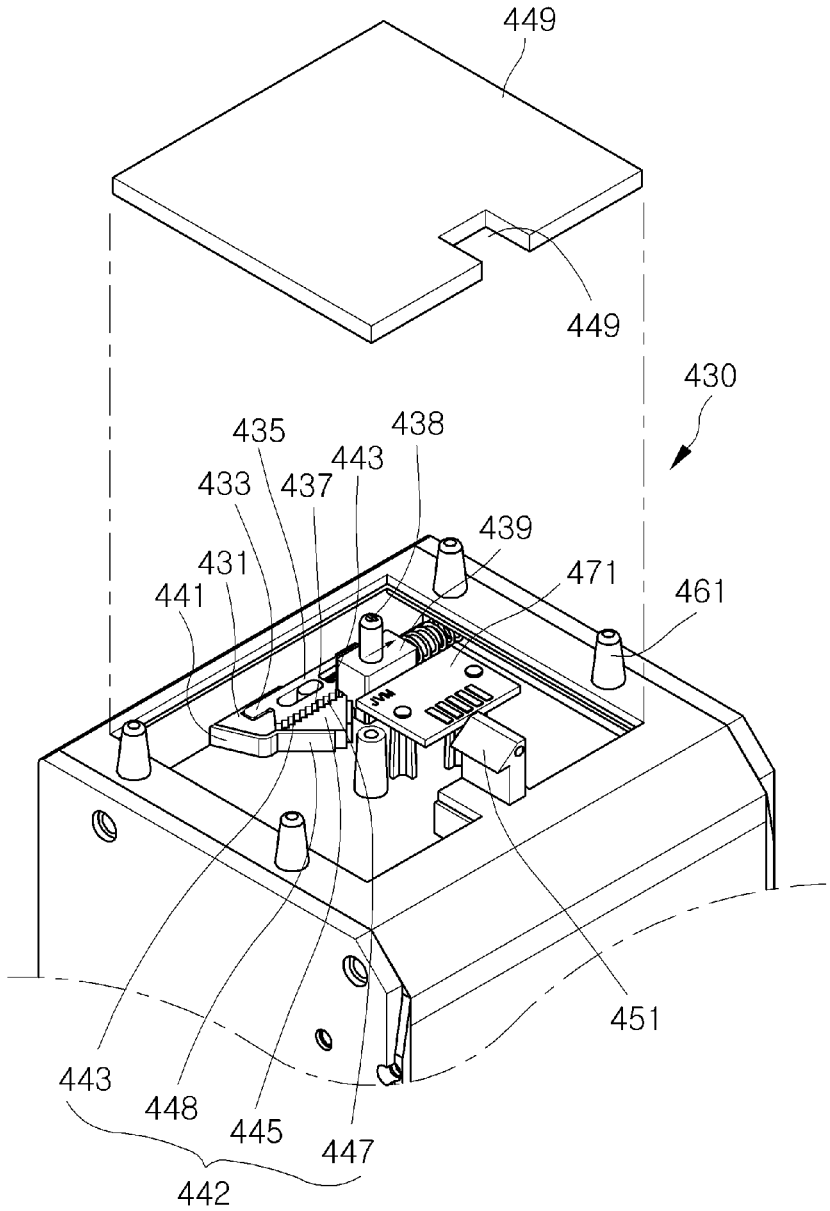
FIG. 22 is a view illustrating a cover locker of the medicine feeding apparatus according to the present invention.
Figure 23:
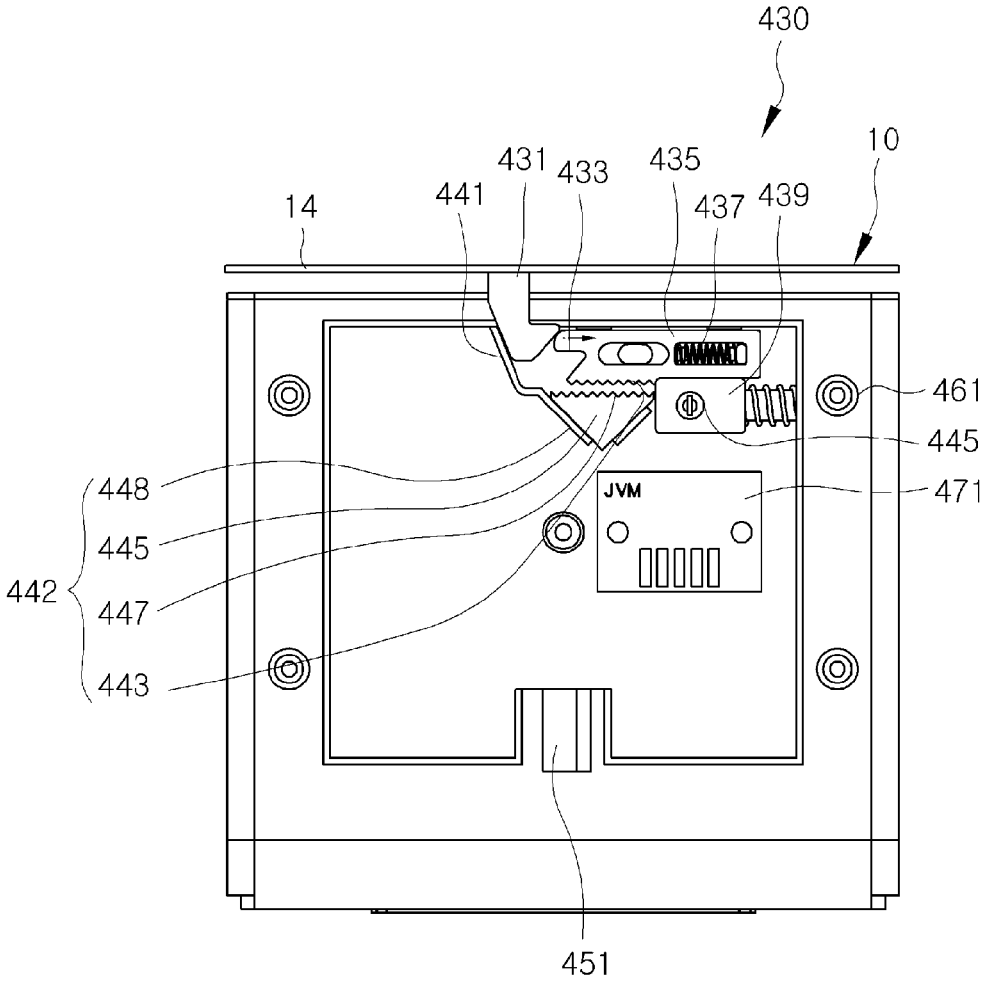
FIG. 23 is a view illustrating an unlocked state of the cover locker of the medicine feeding apparatus according to the present invention.

FIG. 22 is a view illustrating the cover locker of the medicine feeding apparatus according to the present invention, and FIG. 23 is a view illustrating an unlocked state of the cover locker of the medicine feeding apparatus according to the present invention.

Figure 24:
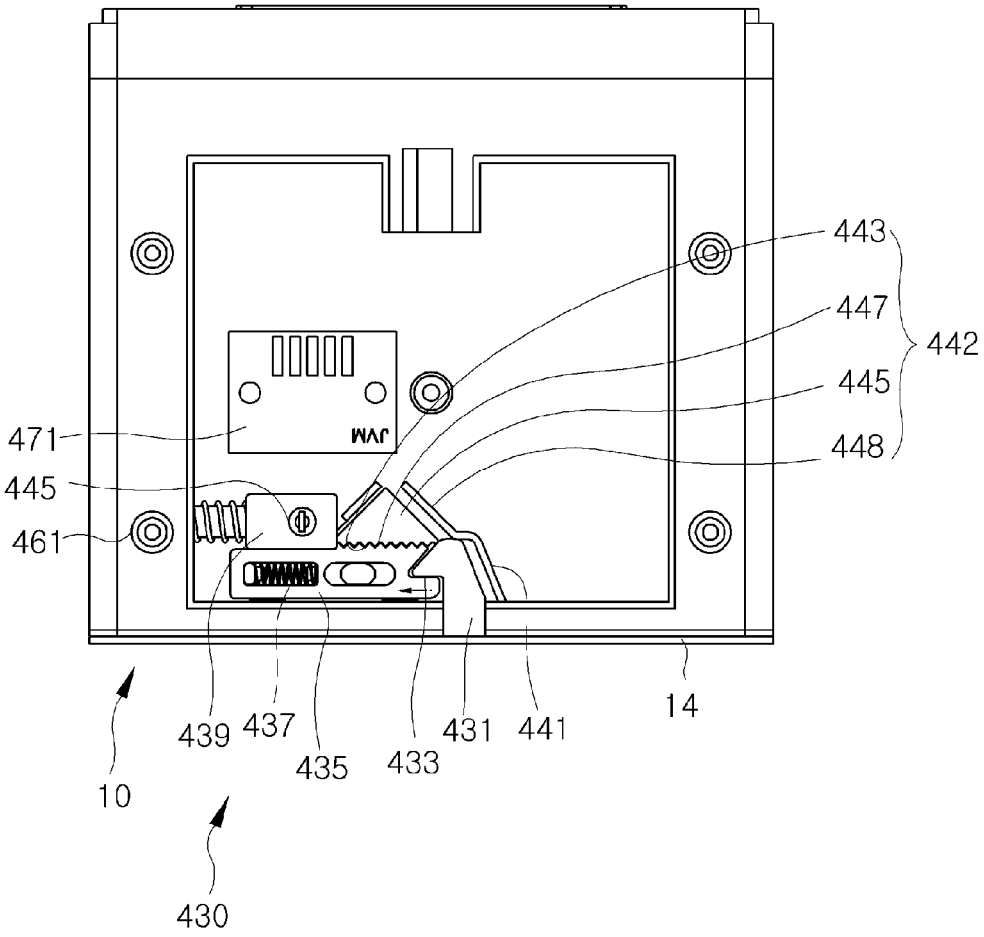
FIG. 24 is a view illustrating a reversed state of the medicine cartridge of the medicine feeding apparatus according to the present invention.
Figure 25:
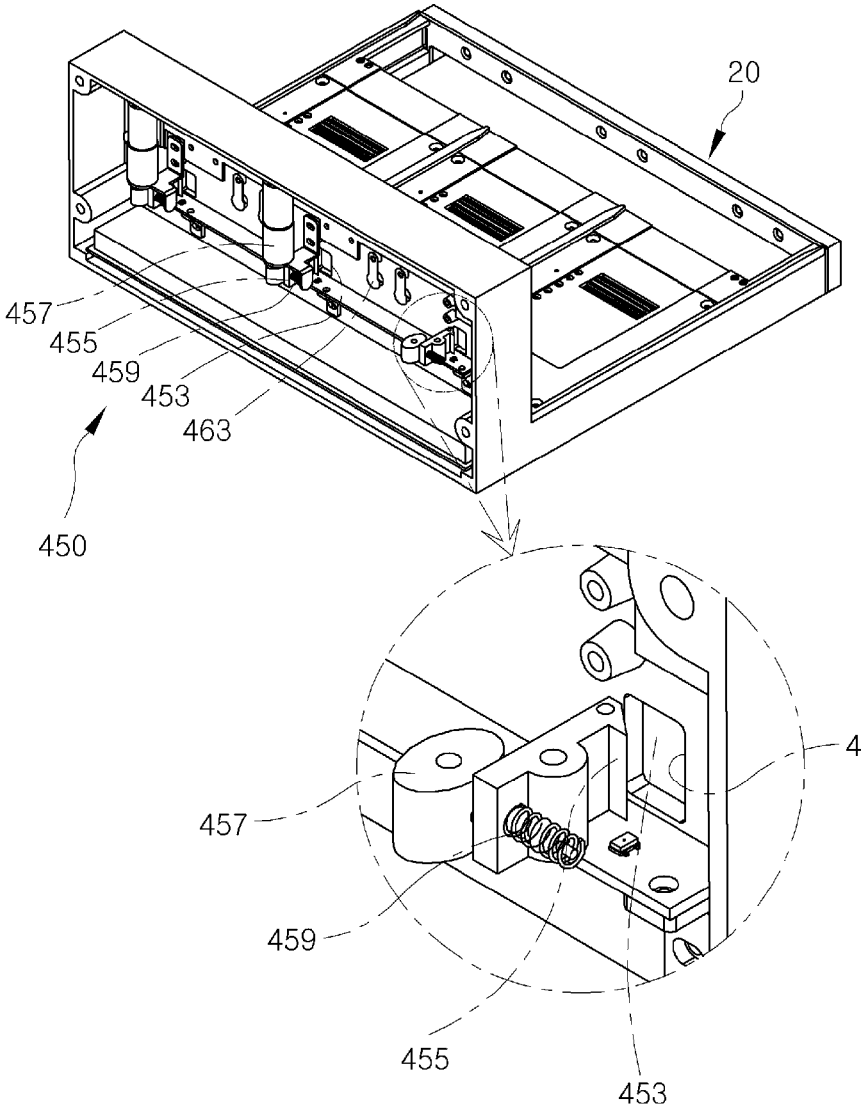
FIG. 25 is a view illustrating a rear surface of the cartridge mount of the medicine feeding apparatus according to the present invention.

FIG. 24 is a view illustrating a reversed state of the medicine cartridge of the medicine feeding apparatus according to the present invention, and FIG. 25 is a view illustrating a rear surface of the cartridge mount of the medicine feeding apparatus according to the present invention.

As illustrated, the cover locker 430 includes a protrusion 431 protruding downward from an end of the cover 14 to lock the cover 14 when the cover 14 covers the entrance opening 13, and a retainer member 435 provided at the rear surface of the medicine cartridge 10, the retainer member 435 having a recess 433 corresponding to the protrusion 431 of the cover 14 such that the protrusion 431 is separably inserted into the recess 433.

To prevent an authorized user from taking out the medicine products, the medicine cartridge 10 and the cartridge mount 20 are provided with the cover locker 430 to lock the cover 14 when the cover 14 covers the entrance opening 13 of the medicine cartridge 10 and the cartridge locker 450 to lock the medicine cartridge 10 when the medicine cartridge 10 is mounted on the cartridge mount 20.

In addition to the protrusion 431 which protrudes downward from the end of the cover 14 to lock the cover 14 when the cover 14 covers the entrance opening 13 and the retainer member 435 which is provided at the rear surface of the medicine cartridge 10 and has a recess 433 corresponding to the protrusion 431 of the cover 14 such that the protrusion 431 is separably inserted into the recess 433, the cover locker 430 includes an elastic member 437 to allow the retainer member 435, which has been moved in a given direction when the protrusion 431 is inserted into the recess 433, to be returned to an original position thereof.

A locking member 439 is installed to the retainer member 435. The locking member 439 serves as a moving member to move the retainer member 435 in a given direction such that the protrusion 431 is inserted into or separated from the recess 433.

The locking member 439 allows the medicine cartridge 10 to be opened using a separate key member (not shown) that can be used only by an authorized user. The locking member 439 is operated to move the retainer member 435 in a given direction when the protrusion 431 is inserted into or separated from the recess 433.

In this case, a locking guide member 441 is provided at an outer rear surface of the medicine cartridge 10. The locking guide member 441 is located at the outside of a path along which the protrusion 431 is inserted into the recess 433 so as to surround an outer surface of the protrusion 431, thereby serving to guide the protrusion 431 to be caught by or released from the recess 433 of the retainer member 435.

As illustrated in FIG. 25, when the cover 14 covers the entrance opening 13 of the medicine cartridge 10, the protrusion 431 of the cover 14 is inserted into the recess 433 under guidance of the locking guide member 441. In this case, the retainer member 435 is moved in a given direction while pressing the elastic member 437 and then, is moved in an opposite direction by elasticity of the elastic member 437 after the protrusion 431 is completely inserted into the recess 433. As such, the protrusion 431 can be inserted into the recess 433.

If an authorized user inserts the key member into the locking member 439 in the locked state of the cover 14 so as to move the retainer member 435 in a given direction, the protrusion 431 is separated from the recess 433 and the cover 14 is unlocked. In this case, only an authorized user can use the key member to open the medicine cartridge 10.

The user can open the cover 14 of the medicine cartridge 10 when no more medicine products are accommodated in the medicine cartridge 10 or when medicine products need to be added to the medicine cartridge 10.

The above described cover locker 430 further includes an anti-opening structure 442 to prevent the protrusion 431 from being separated from the recess 433 even if the key member is inserted into the locking member 439 to move the locking member 439 when the medicine cartridge 10 is reversed such that the entrance opening 13 faces downward.

The anti-opening structure 442, as illustrated in FIG. 26, includes a toothed portion 443 provided at a lower surface of the retainer member 435, a stopper member 445 provided with a toothed portion 447 to be engaged with the toothed portion 443 of the retainer member 435, a stopper positioning member 448 located below the stopper member 445 to assist in positioning of the stopper member 445, and a rear cover 449 to cover the rear surface of the medicine cartridge 10.

Here, the stopper positioning member 448 is preferably located to provide a predetermined space between the retainer member 435 and the stopper member 445 such that the stopper member 445 can be spaced apart from the toothed portion 443 of the retainer member 435, rather than being engaged with the toothed portion 443.

More specifically, the stopper member 445 is not secured using a separate fixing means, but has a free end between the retainer member 435 and the stopper positioning member 448. Thus, the stopper member 445 can be vertically movably installed without a risk of separation thereof owing to the rear cover 449.

Thus, in a normal state of the medicine cartridge 10, i.e. in a state in which the entrance opening 13 faces upward, the stopper member 445 is moved downward by gravity and is located to come into contact with the stopper positioning member 448. Thereby, the user can open the medicine cartridge 10 using the key member as described above.

On the other hand, in a state in which the entrance opening 13 of the medicine cartridge 10 faces downward, the stopper member 445 is moved downward by gravity and the toothed portion 447 of the stopper member 445 is engaged with the toothed portion 443 of the retainer member 435. Thus, the retainer member 435 cannot be moved completely even if the user attempts to move the locking member 438 using the key member. That is, it is impossible to open the entrance opening 13 of the medicine cartridge 10 when the medicine cartridge 10 is reversed.

This can prevent the medicine products accommodated in the medicine cartridge 10 from being unintentionally discharged through the entrance opening 13 when the medicine cartridge 10 is reversed.

Referring to FIG. 25, the cartridge locker 450 includes a coupling protrusion 451 protruding from the rear surface of the medicine cartridge 10, and a coupling recess 453 indented in the cartridge mount 20 at a position corresponding to the coupling protrusion 451 for insertion of the coupling protrusion 451. When the medicine cartridge 10 is mounted on the cartridge mount 20, the coupling protrusion 451 is inserted into the coupling recess 453, assisting in mounting the medicine cartridge 10 on the cartridge mount 20.

In the present invention, a memory chip 471 in which information on the medicine cartridge 10 is stored is attached to the rear surface of the medicine cartridge 10, and a memory reader (not shown) to read information stored in the memory chip 471 is attached to the cartridge mount 20. As such, once the medicine cartridge 10 is mounted on the cartridge mount 20, the memory reader can read information on the medicine cartridge 10 from the memory chip 471.

Specifically, the memory chip 471 provided at the medicine cartridge 10 stores the serial number of the medicine cartridge 10, information on the accommodated medicine products, etc., and provides them to the memory reader provided at the cartridge mount 20.

Here, the cartridge locker 450 further includes a separator to separate the coupling protrusion 451 from the coupling recess 453, in order to prevent the coupling protrusion 451 from being arbitrarily separated from the coupling recess 453 after the medicine cartridge 10 is mounted on the cartridge mount 20.

The separator includes a rotatable pressure member 455 installed to the rear surface of the cartridge mount 20 at one side of the coupling recess 453, the rotatable pressure member 455 being rotated to press the coupling protrusion 451 inserted in the coupling recess 453 so as to separate the coupling protrusion 451 from the coupling recess 453, a separator drive unit 457 to drive the rotatable pressure member 455, and a central control unit (not shown) to send a drive signal to the separator drive unit 457 when a user inputs a separation signal to separate the medicine cartridge 10 from the cartridge mount 20.

Preferably, an elastic member 459 is provided at one side of the rotatable pressure member 455 to return the rotatable pressure member 455 to an original position thereof if the separator drive unit 457 is not driven.

In addition, at least one damping boss 461 protrudes from the rear surface of the medicine cartridge 10, and a hole (not designated by a reference numeral) for insertion of the damping boss 461 is formed in the rear surface of the cartridge mount 20 at a position corresponding to the damping boss 461 when the medicine cartridge 10 is mounted on the cartridge mount 20. In addition, an elastic damping member 463 is installed at the rear of the hole. Here, the elastic damping member 463 may be a leaf spring.

The damping boss 461 and the elastic damping member 463 serve to alleviate shock applied to the medicine cartridge 10 when the medicine cartridge 10 is mounted on or separated from the cartridge mount 20. The damping boss 461 is preferably an elastic member.

In particular, the elastic damping member 463 in the form of a leaf spring presses the damping boss 461 when the rotatable pressure member 455 presses the coupling protrusion 451 to separate the coupling protrusion 451 from the coupling recess 453 under operation of the separator drive unit 457, thereby alleviating force generated upon separation of the medicine cartridge 10, which can alleviate shock applied to the medicine cartridge 10 in which, e.g., fragile ampoules are accommodated.

In the present invention, a plurality of medicine cartridges 10 and cartridge mounts 20 is mounted in the main body 10, the number of which is equal to the number of kinds of medicine products used. When the plurality of medicine cartridges 10 and cartridge mounts 20 is arranged one above another, the outer discharge hole 21 of the cartridge mount 20 is located close to the upper surface of the medicine cartridge 10 below the cartridge mount 20.

The upper surface of the medicine cartridge 10 is preferably provided with a seating guide member 19. An upper surface of the seating guide member 19 facing the outer discharge hole 21 is downwardly inclined to guide the medicine products discharged from the outer discharge hole 21 located above the medicine cartridge 10 to the transfer device T.

A plurality of discharge grooves 19*a* is formed in the upper surface of the seating guide member 19. The discharge grooves 19*a* serve to minimize a contact area between the medicine products and the seating guide member 19. This minimizes friction between the medicine products and the seating guide member 19, thereby preventing damage to the medicine products during discharge of the medicine products.

In addition, raised grip portions 19*b* are preferably formed at a lower surface of the seating guide member 19.

The raised grip portions 19*b* are gripped by the user when the medicine cartridge 10 is mounted on or separated from the cartridge mount 20, and help the user to stably mount or separate the medicine cartridge 10.

As such, the medicine products discharged through the outer discharge hole 21 are transferred downward along the seating guide member 19 of the medicine cartridge 10 located below the outer discharge hole 21, thereby being easily and stably seated on the transfer device T.

Referring again to FIG. 1, the transfer device T includes the conveyor belt T1 which has a sufficient length to connect one side and the other side of the transfer device T to each other, the collector T2 which is located close to one side of the conveyor belt T1 and serves to collect the medicine products M seated on the conveyor belt T1 so as to discharge the medicine products M to the outside of the main body B, and the elevator T3 which serves to raise or lower the conveyor belt T1.

The medicine products discharged through the outer discharge hole 21 are seated on the conveyor belt T1, and the conveyor belt T1 is raised or lowered by the elevator T3 such that one end of the conveyor belt T1 is moved toward or away from the collector T2. If the end of the conveyor belt T1 is located close to the collector T2, the conveyor belt T1 is rotated such that the medicine seated on the conveyor belt T1 is introduced into the collector T2. The user can provide the medicine products collected in the collector T2 to patients.

Hereinafter, operation of the medicine feeding apparatus having the above described configuration will be described in detail.

First, medicine products are put into the medicine cartridge 10 through the entrance opening 13 formed in the top of the medicine cartridge 10.

In this case, if an authorized user inserts the key member into the locking member 445 to move the retainer member 435 in a given direction, the coupling protrusion 431 is separated from the recess 433 of the retainer member 435, causing the cover 14 to be opened.

If the cover 14 is closed to cover the entrance opening after designated medicine products are put into the medicine cartridge 10, the protrusion 431 is inserted into the recess 433 under guidance of the locking guide member 441.

Thereby, if the protrusion 431 is caught by the recess 433 after the retainer member 435 is temporarily moved in a given direction, the retainer member 435 is returned to an original position thereof by the elastic member 437.

As described above, the cover 14 can be opened only by the authorized user using the key member.

Next, the medicine cartridge 10, in which the medicine products are accommodated, is mounted on the cartridge mount 20. In this case, the user can mount the medicine cartridge 10 by gripping the seating guide member 19 extending from the upper surface of the medicine cartridge 10. The raised grip portions 19*b* formed at the lower surface of the seating guide member 19 function to prevent slippage.

Once the medicine cartridge 10 is mounted on the cartridge mount 20, the coupling protrusion 451 of the medicine cartridge 10 is inserted into the coupling recess 453 of the cartridge mount 20, thereby allowing the medicine cartridge 10 to be secured to the cartridge mount 20 by the cartridge locker 450.

In this case, the memory reader provided at the cartridge mount 20 can read information on the medicine products stored in the memory chip 471 provided at the medicine cartridge 10.

For example, if the number of discharged medicine products sensed by the discharge sensor 315 is equal to the number of medicine products initially accommodated in the medicine cartridge 10, the central control unit sends a drive signal to the separator drive unit 457. The separator drive unit 457 rotates the rotatable pressure member 455 to press the coupling protrusion 451, thereby causing the coupling protrusion 451 to be separated from the coupling recess 453. In this way, the medicine cartridge 10 can be separated from the cartridge mount 20.

After medicine products are added into the medicine cartridge 10 as described above, the separated medicine cartridge 10 is again mounted on the cartridge mount 20.

In the meantime, if the central control unit sends a medicine discharge signal to provide the medicine products to patients, the discharge drive unit is driven to discharge the medicine products through the discharge hole 15.

Thereby, the medicine products fall through the discharge hole 15 of the medicine cartridge 10 and are delivered to the transfer device T through the outer discharge hole 21 of the cartridge mount 20.

The medicine products delivered to the transfer device T are seated on the conveyor belt T1 and are transferred to the user via the collector T2 to fill a prescription.

In the present invention, the damping boss 461 protrudes from the rear surface of the medicine cartridge 10 and the hole (not designated by a reference numeral) for insertion of the damping boss 461 is formed at the rear surface of the cartridge mount 20 at a position in contact with the damping boss 461 when the medicine cartridge 10 is mounted on the cartridge mount 20. In addition, the elastic damping member 463 is provided at the rear of the hole.

Here, the elastic damping member 463 may be a leaf spring.

The damping boss 461 and the elastic damping member 463 serve to alleviate shock applied to the medicine cartridge 10 when the medicine cartridge 10 is mounted on or separated from the cartridge mount 20. The damping boss 461 is preferably an elastic member.

The elastic damping member 463 in the form of a leaf spring presses the damping boss 461 when the rotatable pressure member 455 presses the coupling protrusion 451 to separate the coupling protrusion 451 from the coupling recess 453 under operation of the separator drive unit 457, thereby alleviating force generated upon separation of the medicine cartridge 10, which can alleviate shock applied to the medicine cartridge 10 in which, e.g., fragile ampoules are accommodated.

The number of medicine cartridges 10 and cartridge mounts 20 mounted in the main body 10 is substantially equal to the number of kinds of medicine products used. When the plurality of medicine cartridges 10 and cartridge mounts 20 is arranged one above another, the outer discharge hole 21 of the cartridge mount 20 is located close to the upper surface of the medicine cartridge 10 below the cartridge mount.

As the upper surface of the medicine cartridge 10 is provided with the seating guide member 19, the upper surface of which facing the outer discharge hole 21 is downwardly inclined, the medicine products discharged from the outer discharge hole 21 located above the seating guide member 19 can be guided to the transfer device T.

The seating guide member 19 has the plurality of discharge grooves 19*a* formed in the upper surface thereof to minimize a contact area between the medicine products and the seating guide member 19. This minimizes friction between the medicine products and the seating guide member 19, thereby preventing damage to the medicine products during discharge of the medicine products.

In addition, the seating guide member 19 has the raised grip portions 19*b* formed at the lower surface thereof.

The raised grip portions 19*b* are gripped by the user when the medicine cartridge 10 is mounted on or separated from the cartridge mount 20, and help the user to stably mount or separate the medicine cartridge 10.

As such, the medicine products discharged through the outer discharge hole 21 can be transferred downward along the seating guide member 19 of the medicine cartridge 10 located below the outer discharge hole 21, thereby being easily and stably seated on the transfer device T.

The transfer device T, referring again to FIG. 1, includes the conveyor belt T1 which has a sufficient length to connect one side and the other side of the transfer device T to each other, the collector T2 which is located close to one side of the conveyor belt T1 and serves to collect the medicine products M seated on the conveyor belt T1 so as to discharge the medicine products M to the outside of the main body B, and the elevator T3 which serves to raise or lower the conveyor belt T1.

The medicine products discharged through the outer discharge hole 21 are seated on the conveyor belt T1, and the conveyor belt T1 is raised or lowered by the elevator T3 such that one end of the conveyor belt T1 is moved toward or away from the collector T2. If the end of the conveyor belt T1 is located close to the collector T2, the conveyor belt T1 is rotated such that the medicine seated on the conveyor belt T1 is introduced into the collector T2. The user can provide the medicine products collected in the collector T2 to patients.

As is apparent from the above description, the present invention provides a medicine feeding apparatus having the following several effects.

In the medicine feeding apparatus according to the present invention, a medicine cartridge is provided with a medicine discharge mechanism, and a discharge drive mechanism is provided at the medicine cartridge and a cartridge mount. Thus, medicine products accommodated in the medicine cartridge can be automatically dispensed by simply mounting the medicine cartridge on the cartridge mount.

According to the present invention, the medicine cartridge has an inclined bottom surface such that the medicine products can be discharged through an open discharge hole of the medicine cartridge without requiring a separate member to push the medicine products out of the medicine cartridge. This can simplify a medicine discharge configuration of the medicine cartridge.

In particular, according to the present invention, a discharge member to open the discharge hole is provided so as to be moved by elasticity of an elastic member. As the discharge member functions to push and discharge the medicine products, the medicine products can be discharged in a more simplified manner without a separate discharge means.

In the present invention, a discharge member position sensor to sense the position of the discharge member is provided, enabling control of an opening rate of the discharge hole by the discharge member. Consequently, the discharge member can be operated to open the discharge hole by an accurate opening rate.

In addition, according to the present invention, the medicine cartridge contains a partition member to divide the interior space of a cartridge body. The position of the partition member can be adjusted based on the size of medicine products to provide a medicine accommodation space adapted to the size of medicine products, which can prevent damage to the medicine products due to collision between the medicine products.

Furthermore, according to the present invention, a locker is provided to prevent operation of the discharge member. The locker allows the discharge member to discharge the medicine products only when the medicine cartridge is mounted on the cartridge mount, which can prevent unwanted discharge of the medicine products.

Specifically, when the medicine cartridge is mounted on the cartridge mount, the discharge member is unlocked using attractive force between oppositely charged magnets, thereby opening the discharge hole of the medicine cartridge, which prevents arbitrary opening of the discharge hole.

In addition, according to the present invention, the medicine discharge mechanism may include a rotatable partitioned conveyor belt, on an upper surface of which partition members are provided to allow each medicine product seated on the conveyor belt to be accommodated in an independent space.

The partitioned conveyor belt of the present invention is rotatably supported on a rotating shaft. As the partitioned conveyor belt is turned downward when being rotated around the rotating shaft located near above the discharge hole, the medicine products on the partitioned conveyor belt can fall through the discharge hole at a predetermined interval.

Alternatively, the medicine discharge mechanism may include screw members, screw threads of which define accommodation spaces to individually accommodate, e.g., pouch type medicine products. The accommodated medicine products can be simply discharged via rotation of the screw members, which ensures automated feeding of the medicine products without damage to the medicine products.

In the present invention, furthermore, a cover locker is provided to lock a cover provided at the medicine cartridge such that the cover can only be opened using a key member, which can prevent an unauthorized user from taking out the medicine products during transfer of the medicine cartridge.

The cover locker according to the present invention is provided with an anti-opening structure to ensure that the medicine cartridge cannot be opened even using the key member in a reversed state of the medicine cartridge. This can prevent unwanted discharge of the medicine products from the reversed medicine cartridge, thus preventing damage to the medicine products.

Finally, according to the present invention, the medicine cartridge is locked simultaneously with that it is mounted on the cartridge mount. Only an authorized user can separate the medicine cartridge from the cartridge mount and thus, it is possible to prevent the medicine cartridge from being arbitrarily separated by an unauthorized user.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A medicine feeding apparatus comprising:

a medicine cartridge having an entrance opening formed in the top thereof, through which a medicine product is put into the medicine cartridge, the entrance opening being provided with a cover, and a discharge hole formed in a front position of the bottom thereof, through which the medicine product is discharged under operation of a medicine discharge mechanism provided at the medicine cartridge;

a cartridge mount having an upper surface, on which the medicine cartridge is mounted, and an outer discharge hole communicating with the discharge hole to discharge the medicine product from the cartridge mount; and a discharge drive mechanism provided at the medicine cartridge and the cartridge mount to drive the medicine discharge mechanism, wherein the medicine cartridge is provided with a cover locker to lock the cover used to cover the entrance opening of the medicine cartridge, and wherein the cover locker includes:

a protrusion protruding downward from an end of the cover to lock the cover simultaneously when the cover covers the entrance opening;

a retainer member provided at the rear surface of the medicine cartridge and having a recess corresponding to the protrusion of the cover such that the protrusion is inserted into or separated from the recess as the retainer member is moved in a given direction or an opposite direction; and an elastic member connected to the retainer member to allow the retainer member, which has been moved when the protrusion is inserted into the recess to be returned to an original position thereof, wherein the cover locker further includes an anti-opening structure to prevent opening of the entrance opening of the medicine cartridge even if the key member is used in a state in which the entrance opening of the medicine cartridge faces downward.

2. The medicine feeding apparatus according to claim 1, wherein the medicine cartridge has an inclined inner bottom surface, wherein the medicine discharge mechanism includes:

a discharge path spaced apart from the bottom surface and having an intermediate discharge hole located above the outer discharge hole of the cartridge mount; and a discharge member installed in the discharge path to open the discharge hole of the medicine cartridge to enable discharge of the medicine product through the discharge hole and close the discharge hole when the medicine product is discharged from the discharge path through the intermediate discharge hole and simultaneously, press the medicine product to discharge the medicine product to the outer discharge hole, and wherein the discharge member is driven by the discharge drive mechanism.

3. The medicine feeding apparatus according to claim 2, wherein the discharge drive mechanism includes:

a rack member provided at a lower surface of the discharge member;

a rotatable pinion member provided at the upper surface of the cartridge mount and engaged with the rack member;

a discharge drive unit to drive the pinion member; and a discharge controller to control operation of the medicine discharge mechanism.

4. The medicine feeding apparatus according to claim 2, wherein an elastic member is installed in the discharge path and is connected to the discharge member so as to return the discharge member to an original position thereof after the discharge member is moved to open the discharge hole.

5. The medicine feeding apparatus according to claim 3, wherein the medicine discharge mechanism further includes a discharge sensor to sense whether or not the medicine product is discharged through the discharge hole of the medicine cartridge and send the sensed signal to the discharge controller, and wherein if the discharge sensor does not sense discharge of the medicine product, the discharge controller sends a drive signal to the discharge drive unit so as to further open the discharge hole via movement of the discharge member.

6. The medicine feeding apparatus according to claim 5, wherein the medicine discharge mechanism further includes a discharge member position sensor to sense a position of the discharge member so as to control a movement interval of the discharge member by the discharge drive unit.

7. The medicine feeding apparatus according to claim 2, wherein the medicine cartridge is provided with a space modifier unit to adjust the size of an accommodation space to match to the size of the medicine product accommodated in the medicine cartridge, and wherein the space modifier unit includes:

slot members respectively provided at opposite inner surfaces of the medicine cartridge and each having a plurality of slots; and an inner partition member, both ends of which are inserted into the slots of the slot members to divide the interior of the medicine cartridge.

8. The medicine feeding apparatus according to claim 2, wherein a discharge locker is provided at the medicine cartridge and the cartridge mount to lock operation of the discharge drive mechanism, wherein the discharge locker includes a stationary magnet accommodating recess indented in the upper surface of the cartridge mount to accommodate a stationary magnet therein, and a movable magnet accommodating recess indented in a lower surface of the medicine cartridge at a position corresponding to the stationary magnet accommodating recess to accommodate a movable magnet therein, wherein the movable magnet accommodating recess is defined in the lower surface of the medicine cartridge and the discharge member such that an upper portion of the movable magnet is inserted into the discharge member and a lower portion of the movable magnet is inserted into the lower surface of the medicine cartridge, and wherein an elastic member is installed in a lower region of the movable magnet accommodating recess to push the upper portion of the movable magnet into the discharge member.

9. The medicine feeding apparatus according to claim 1, wherein the medicine discharge mechanism includes:

rotating shafts rotatably installed in front and rear positions of the medicine cartridge; and a conveyor belt installed to connect the front and rear rotating shafts to each other and engaged with and rotated by the front and rear rotating shafts, and wherein the rotating shafts are driven by the discharge drive mechanism.

10. The medicine feeding apparatus according to claim 9, wherein the conveyor belt is a partitioned conveyor belt provided at an upper surface thereof with a plurality of partition members parallel to the rotating shafts to provide a plurality of divided spaces.

11. The medicine feeding apparatus according to claim 9, wherein the conveyor belt is a slit conveyor belt provided at an upper surface thereof with a plurality of slits such that one end of the medicine product is inserted into a corresponding one of the slits.

12. The medicine feeding apparatus according to claim 9, wherein the discharge drive mechanism includes:

a discharge drive unit installed in the cartridge mount;

a discharge driving gear to be driven by the discharge drive unit, an upper portion of the discharge driving gear being exposed from the upper surface of the cartridge mount;

a discharge driven gear provided at the bottom of the medicine cartridge and engaged with and rotated by the discharge driving gear;

a rotation drive shaft member connected to the discharge driven gear so as to be rotated along with the discharge driven gear; and a rotation drive belt connecting the rotation drive shaft member and the rotating shaft to each other.

13. The medicine feeding apparatus according to claim 12, wherein the rotation drive shaft member is provided with a partition member position sensor to sense a position of the partition member on the partitioned conveyor belt so as to control operation of the discharge drive unit.

14. The medicine feeding apparatus according to claim 1, wherein the medicine discharge mechanism includes:

screw members rotatably installed at opposite inner sides of the medicine cartridge and each having screw threads formed on an outer surface thereof; and rotating shaft members inserted respectively into the screw members to rotate the screw members, both ends of each rotating shaft member being connected to inner front and rear surfaces of the medicine cartridge, and wherein the rotating shaft members are driven by the discharge drive mechanism.

15. The medicine feeding apparatus according to claim 14, wherein a distance between the screw members matches to a length of the medicine product, and wherein a distance between the screw threads formed on the outer surface of the screw member matches to a thickness of the medicine product.

16. The medicine feeding apparatus according to claim 14, wherein the discharge drive mechanism includes:

a discharge drive unit installed in the cartridge mount;

a discharge driving gear installed on the cartridge mount and adapted to be rotated by the discharge drive unit;

a discharge driven gear provided at the bottom of the medicine cartridge so as to be engaged with the discharge driving gear, the discharge driven gear being placed and rotated on a discharge shaft member parallel to the front surface of the medicine cartridge;

a first helical gear placed on an end of the discharge shaft member;

a second helical gear engaged at a right angle with the first helical gear to allow a rotation drive shaft member to be rotated in linkage with the first helical gear;

a rotation driving gear placed on an end of the rotation drive shaft member at the rear surface of the medicine cartridge; and rotation driven gears engaged with the rotation driving gear and placed respectively on the rotating shaft members so as to rotate the rotating shaft members.

17. The medicine feeding apparatus according to claim 1, wherein the medicine discharge mechanism includes:

a bottom member spaced apart from the bottom surface of the medicine cartridge and having a front opening corresponding to the discharge hole and a rear hole;

a moving member having opposite lower ends seated on opposite sides of the bottom member and adapted to be moved forward or rearward of the bottom member;

a support member provided at a front surface of the moving member so as to come into contact with the medicine product accommodated in the medicine cartridge to assist discharge of the medicine product through the discharge hole;

a movable elastic member having a winding roll installed at the rear hole of the bottom member to come into contact with the bottom surface of the medicine cartridge and an elastic piece secured to the bottom member so as to be wound on or unwound from the winding roll and serving to move the moving member; and a discharge roller member provided at one side of the discharge hole, and wherein the discharge roller member is driven by the discharge drive mechanism.

18. The medicine feeding apparatus according to claim 17, wherein the discharge drive mechanism includes:

a discharge drive unit installed in the cartridge mount;

a discharge driving gear to be driven by the discharge drive unit, an upper portion of which is exposed from the upper surface of the cartridge mount;

a discharge driven gear provided at the bottom of the medicine cartridge and engaged with and rotated by the discharge driving gear;

a rotation drive shaft member rotatably connected to the discharge driven gear;

a discharge roller member installed at one side of the discharge hole; and a discharge drive belt connecting the rotation drive shaft member and the discharge roller member to each other.

19. The medicine feeding apparatus according to claim 1, wherein the cover locker further includes a locking member adapted to be moved by a key member and serving to move the retainer member in a given direction so as to separate the protrusion from the recess.

20. The medicine feeding apparatus according to claim 1, wherein the anti-opening structure includes:

a toothed portion provided at a lower surface of the retainer member;

a stopper member having a toothed portion to be engaged with the toothed portion;

a stopper positioning member configured to surround a lower surface of the stopper member and serving to position the stopper member such that the stopper member is movable by a predetermined distance so as to come into contact with the toothed portion of the retainer member or be spaced apart from the toothed portion; and a rear cover to cover the rear surface of the medicine cartridge to which the cover locker is installed.

21. The medicine feeding apparatus according to claim 1, wherein a cartridge locker is provided at the medicine cartridge and the cartridge mount to lock the medicine cartridge mounted on the cartridge mount, and wherein the cartridge locker includes:

a coupling protrusion protruding from the rear surface of the medicine cartridge; and a coupling recess indented in the cartridge mount at a position corresponding to the coupling protrusion for insertion of the coupling protrusion.

22. The medicine feeding apparatus according to claim 21, wherein the cartridge locker further includes:

a rotatable pressure member installed at one side of the coupling recess, the rotatable pressure member being rotated to press the coupling protrusion inserted in the coupling recess so as to separate the coupling protrusion from the coupling recess;

a drive unit to drive the rotatable pressure member; and an elastic member provided at one side of the rotatable pressure member to return the rotatable pressure member to an original position thereof.

23. The medicine feeding apparatus according to claim 21, wherein the cartridge locker further includes:

at least one damping boss protruding from the rear surface of the medicine cartridge to alleviate shock generated when the medicine cartridge is mounted on the cartridge mount; and an elastic damping member provided at the cartridge mount to come into contact with the damping boss when the medicine cartridge is mounted on the cartridge mount.

24. The medicine feeding apparatus according to claim 21, wherein the cartridge locker further includes:

a memory chip attached to the rear surface of the medicine cartridge, the memory chip storing information on the medicine produce accommodated in the medicine cartridge; and a memory reader attached to the cartridge mount to read the information stored in the memory chip.

* * * * *